US007876183B2

(12) United States Patent
Uruma et al.

(10) Patent No.: US 7,876,183 B2
(45) Date of Patent: Jan. 25, 2011

(54) ELECTROMAGNETIC SWITCHING DEVICE

(75) Inventors: Katsuya Uruma, Matsusaka (JP); Masahiro Itou, Ise (JP); Motoharu Kubo, Nakagawa-gun (JP); Ritsu Yamamoto, Obihiro (JP); Riichi Uotome, Katano (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 358 days.

(21) Appl. No.: 11/887,007

(22) PCT Filed: Nov. 21, 2006

(86) PCT No.: PCT/JP2006/323204

§ 371 (c)(1),
(2), (4) Date: Sep. 24, 2007

(87) PCT Pub. No.: WO2007/060945

PCT Pub. Date: May 31, 2007

(65) Prior Publication Data

US 2009/0243771 A1 Oct. 1, 2009

(30) Foreign Application Priority Data

| | | |
|---|---|---|
| Nov. 25, 2005 | (JP) | 2005-341247 |
| Apr. 18, 2006 | (JP) | 2006-114886 |
| Apr. 18, 2006 | (JP) | 2006-114887 |
| Apr. 19, 2006 | (JP) | 2006-116052 |
| Apr. 25, 2006 | (JP) | 2006-121310 |
| Apr. 25, 2006 | (JP) | 2006-121311 |

(51) Int. Cl.
*H01H 67/02* (2006.01)

(52) U.S. Cl. ..... 335/126; 335/131

(58) Field of Classification Search ..... 335/126, 335/131

See application file for complete search history.

(56) References Cited

U.S. PATENT DOCUMENTS 2,531,025 A * 11/1950 Bradley ..... 335/131

(Continued)

FOREIGN PATENT DOCUMENTS

DE 970 017 C 8/1958

(Continued)

OTHER PUBLICATIONS

International Search Report PCT/ISA/210, Int'l App. No. PCT/JP2006/323204, Dec. 26, 2006 (4 pages).

(Continued)

*Primary Examiner*—Anh T Mai
*Assistant Examiner*—Alexander Talpalatskiy
(74) *Attorney, Agent, or Firm*—Cheng Law Group, PLLC

(57) ABSTRACT

This electromagnetic switching device comprises an electromagnetic device 1 in which a movable core 15 comes into contact with or separates from a fixed core 14 in response to energization of an excitation coil 11 wound around a coil bobbin 10 a contact device 2 with a fixed contact 21 and a movable contact which comes into contact with or separates from the fixed contact in conjunction with a movement of the movable core 15 of the electromagnetic device, and a boxy case 3 configured to house the electromagnetic device and the contact device. The coil bobbin 10 has a flange 10*a* at its end in an axis direction of the coil bobbin, and the case 3 has, on its inner surface, a recess 31 into which a periphery of the flange 10*a* of the coil bobbin is fitted, and a cushioning member 32 for absorbing an impact which is transmitted from the electromagnetic device to the case is disposed in the recess, and the flange of the coil bobbin is supported by the recess through the cushioning member whereby the electromagnetic device is supported in the case.

31 Claims, 19 Drawing Sheets

U.S. PATENT DOCUMENTS

| | | | | |
|---|---|---|---|---|
| 2,782,282 | A * | 2/1957 | Schrack | 335/281 |
| 3,134,869 | A | 5/1964 | Lawrence | |
| 3,215,800 | A | 11/1965 | Hurter | |
| 5,210,928 | A | 5/1993 | Seshita et al. | |
| 5,892,194 | A * | 4/1999 | Uotome et al. | 218/68 |
| 5,956,996 | A * | 9/1999 | Nara et al. | 74/7 R |
| 6,155,856 | A | 12/2000 | Sanada | |
| 6,229,416 | B1 | 5/2001 | Ebihara et al. | |
| 6,269,706 | B1 * | 8/2001 | Kuragaki et al. | 74/7 A |
| 6,911,884 | B2 * | 6/2005 | Uotome et al. | 335/132 |
| 7,157,995 | B2 * | 1/2007 | Nishida et al. | 335/126 |
| 2004/0056743 | A1 * | 3/2004 | Maruhashi et al. | 335/126 |
| 2005/0146405 | A1 * | 7/2005 | Nishida et al. | 335/132 |

FOREIGN PATENT DOCUMENTS

| | | | |
|---|---|---|---|
| DE | 1 908 658 | U | 1/1965 |
| DE | 1 914 697 | U | 4/1965 |
| EP | 0 715 326 | A2 | 6/1996 |
| EP | 1 548 781 | A2 | 6/2005 |
| FR | 2 298 181 | A1 | 8/1976 |
| GB | 734 099 | A | 7/1955 |
| GB | 1064648 | A | 4/1967 |
| JP | 50-34729 | | 4/1975 |
| JP | 54-24649 | | 2/1979 |
| JP | 54-146353 | U | 10/1979 |
| JP | 55-34964 | U | 3/1980 |
| JP | 62-26850 | U | 2/1987 |
| JP | 63-111742 | U | 7/1988 |
| JP | 1-137040 | U | 9/1989 |
| JP | 1-150326 | U | 10/1989 |
| JP | 1-166945 | U | 11/1989 |
| JP | 5-22886 | A | 1/1993 |
| JP | 06-162901 | A | 6/1994 |
| JP | 07-16337 | U | 3/1995 |
| JP | 9-320437 | A | 12/1997 |
| JP | 10-106841 | A | 4/1998 |
| JP | 10-134690 | A | 5/1998 |
| JP | 10-188711 | A | 7/1998 |
| JP | 11-232986 | A | 8/1999 |
| JP | 2000-164276 | A | 6/2000 |
| JP | 2000-215774 | A | 8/2000 |
| JP | 2001-43788 | A | 2/2001 |
| JP | 2002-184290 | A | 6/2002 |
| JP | 2005-123064 | A | 5/2005 |
| JP | 2005-228650 | A | 8/2005 |

OTHER PUBLICATIONS

Written Opinion of the International Searching Authority PCT/ISA/237, Int'l Appln. No. PCT/JP2006/323204, Dec. 26, 2006, (5 pages).

Supplementary European Serach Report for the Application No. EP 06 83 3050 dated Jan. 29, 2010.

Notification of Reasons for Refusal for the Application No. 2006-121310 from Japan Patent Office mailed Feb. 23, 2010.

Notification of Reasons for Refusal for the Application No. 2006-114886 from Japan Patent Office mailed Oct. 13, 2009.

Notification of Reasons for Refusal for the Application No. 2006-121310 from Japan Patent Office mailed Oct. 13, 2009.

Notification of Reasons for Refusal for the Application No. 2005-341247 from Japan Patent Office mailed Oct. 20, 2009.

* cited by examiner

ELECTROMAGNETIC SWITCHING DEVICE

TECHNICAL FIELD

The present invention relates to an electromagnetic switching device having, in a case, an electromagnetic device and a contact device which opens and closes between contacts in conjunction with the motion of the electromagnetic device.

BACKGROUND ART

Japanese Non-examined Patent Publication No. 11-232986 discloses an electromagnetic switching device having an electromagnetic device and a contact device in a case.

The electromagnetic switching device comprises an electromagnetic device in which a movable core comes into contact with or separates from a fixed core in response to energization of an excitation coil wound around a coil bobbin, a contact device with a fixed contact and a movable contact which comes into contact with or separates from the fixed contact in conjunction with the movement of the movable core of the electromagnetic device, and a boxy case for housing the electromagnetic device and the contact device. The movable contact is supported by a movable armature, and the armature is connected to the movable core through a movable shaft.

In this electromagnetic switching device, when the excitation coil is energized, the movable core moves to the fixed core side, and the movable shaft and the movable armature move in conjunction with the movement of the movable core, and as a result, the movable contact comes into contact with the fixed contact. When the energization of the excitation coil is stopped, the movable core separates from the fixed core by a spring force of a return spring provided between the fixed core and the movable core, so that the movable contact separates from the fixed contact.

By the way, in the above electromagnetic switching device, when the movable core makes contact with the fixed core, a vibration (or, an impact) occurs. If the vibration is transmitted to the case, the case itself also vibrates, so, for example, the case may come in contact with some part, and a noise may emanate.

DISCLOSURE OF THE INVENTION

In view of the above problem, the object of the present invention is to provide an electromagnetic switching device capable of reducing a vibration to be transmitted from the electromagnetic device to the case.

An electromagnetic switching device of the present invention comprises an electromagnetic device in which a movable core comes into contact with or separates from a fixed core in response to energization of an excitation coil wound around a coil bobbin, a contact device with a fixed contact and a movable contact which comes into contact with or separates from the fixed contact in conjunction with a movement of said movable core of said electromagnetic device, and a boxy case for housing said electromagnetic device and said contact device.

The feature of the present invention resides in that the coil bobbin has a flange at its end in an axis direction of the coil bobbin, and the case has, on its inner surface, a recess in which a periphery of the flange of the coil bobbin is fitted, and a cushioning member for absorbing an impact to be transmitted from the electromagnetic device to the case is disposed in the recess, and the flange of the coil bobbin is supported by the recess through the cushioning member whereby the electromagnetic device is supported in the case.

In the electromagnetic switching device of the present invention, because the electromagnetic device is supported by the case through the cushioning member, the vibration generated in the electromagnetic device is not transmitted to the case directly, and it is absorbed by the cushioning member. Therefore, the vibration generated in the electromagnetic device is not easily transmitted to the case, whereby it is possible to reduce the vibration to be transmitted from the electromagnetic device to the case. Furthermore, because the flange of the coil bobbin is away from the movable core and the fixed core, which are the source of the impact, it is possible to reduce the impact to be transmitted from the electromagnetic device to the case more by supporting such a flange by the case.

Preferably, the cushioning member is made of a raw material having many air spaces in it. In this case, the impact transmitted from the electromagnetic device is attenuated as it passes through many air spaces, so it is possible to reduce the impact to be transmitted from the electromagnetic device to the case with a high degree of efficiency.

It is preferable that the cushioning member is formed by stacking a plurality of fine materials formed into, for example, a cloth shape or a nonwoven fabric shape. In this case, the impact repeats an input motion, a propagation motion, and an output motion among the stacked fine materials, and it is attenuated when it enters and goes out of the fine materials, whereby it is possible to reduce the impact to be transmitted from the electromagnetic device to the case with a high degree of efficiency.

Preferably, the contact device has a fixed terminal connected to the fixed contact, and the case has a terminal window for exposing the fixed terminal to the outside, and a second cushioning member is disposed so that it fills a gap between a periphery of the terminal window and the contact device. In this case, by the second cushioning member, it is possible to prevent an entry of a foreign object into the case through the terminal windows. Furthermore, because the second cushioning member fills the gap between the periphery of the terminal window and the contact device, the transmission of the impact to the case is suppressed.

Preferably, the electromagnetic device has a fixed plate for holding the fixed core, and the fixed plate has a through hole through which one end of the fixed core passes, and the fixed core has a cylindrical shape with a flange at its end, and the flange is locked to a periphery of the through hole of the fixed plate, and the fixed plate has a cap which covers the flange of the fixed core and restricts a movement of the fixed core, and a third cushioning member made of a material having elasticity is disposed between the cap and the flange.

In this case, the impact generated when the movable core hit against the fixed core is absorbed by the third cushioning member, and the impact itself generated in the electromagnetic device can be suppressed. So, as a result, it is possible to reduce the impact to be transmitted to the case.

Preferably, the cap has a support protrusion on a surface facing the third cushioning member, and an end of the support protrusion is in contact with the third cushioning member. In this case, pressure which is applied to a portion of the third cushioning member which is in contact with the support protrusion becomes higher, and the amount of deformation of the portion increases. As a result, it is possible to increase the impact absorbing effect of the third cushioning member.

Preferably, the support protrusion is formed into an annular shape around a center axis of the fixed core. In this case, it is possible to absorb the impact transmitted from the fixed core to the cap through the third cushioning member evenly along an annular shape around the center axis of the fixed core.

Or, it is also preferable that the support protrusion is formed on a part of an annular shape around a center axis of the fixed core. In this case, as compared with the case where the support protrusion is formed into the annular shape, the pressure applied to the third cushioning member is concentrated to the portion which the support protrusion is in contact with. Therefore, the amount of deformation of the portion of the cushioning member which is in contact with the support protrusion is increased, so it is possible to more fully absorb the impact generated when the movable core hit the fixed core. Furthermore, as compared with the case where the support protrusion is formed into the annular shape, because the contact area between the support protrusion and the cushioning member decreases, an area through which the impact is transmitted to the cap decreases, and the transmission of the impact is suppressed more.

Preferably, an end of the support protrusion which is in contact with the third cushioning member is formed into a curved surface which projects to the third cushioning member side. Or, it is also preferable that the end of the support protrusion which comes in contact with the third cushioning member is tapered toward the third cushioning member side. In these cases, because the contact area between the support protrusion and the third cushioning member decreases more, and the pressure applied to the portion of the cushioning member which is in contact with the support protrusion becomes much higher, it is possible to more efficiently absorb the impact generated when the movable core hits the fixed core. Furthermore, because the contact area between the support protrusion and the cushioning member decreases more, the transmission of the impact is more suppressed.

It is preferable that the cap is made of a metal plate, and the support protrusion is formed by cutting and bending the metal plate and it has flexibility in an axis direction of the fixed core. In this case, not only the third cushioning member but also the support protrusion can absorb the impact generated when the movable core hit the fixed core by bending, whereby the transmission of the impact generated in the electromagnetic device to the cap is more suppressed.

In the above case, it is preferable that an end of the support protrusion which is in contact with the third cushioning member is bent toward the third cushioning member side. In this case, the contact area between the support protrusion and the third cushioning member is reduced, whereby the impact generated when the movable core hit the fixed core can be more absorbed by the third cushioning member. Furthermore, because the contact area between the support protrusion and the third cushioning member is reduced, the transmission of the impact is more suppressed.

The cap may comprise a rectangular main wall which covers an end face of the flange of the fixed core, side walls which are formed by bending ends of the main wall toward the flange side and cover a side surface of the flange, and fixed parts which are formed by bending an end of each side wall and are fixed to the fixed plate. In this case, because the cap can be manufactured by bending process, it is possible to lower the cost for manufacturing the cap.

In the above case, it is preferable that the side walls are formed by bending a pair of ends of the main wall toward the flange side, and the cap further comprises reinforcing walls which are formed by bending the other pair of ends of the main wall toward the flange side and whose ends are in contact with the fixed plate. In this case, it is possible to increase the strength of the cap.

Furthermore, it is preferable that the cap further comprises welding parts which are formed by bending ends of the reinforcing walls and are welded to the fixed plate. In this case, it is possible to weld the cap to the fixed plate.

Furthermore, it is preferable that the cap further comprises a connection part for connecting between each of the side walls and each of the fixed parts. In this case, it is possible to further increase the strength of the cap, and it is possible to stabilize the shape of the side walls and the fixed parts.

Preferably, the contact device has a movable armature having the movable contact, a movable shaft whose one end is connected to the movable armature and the other end is connected to the movable core, and a contact pressure spring which is disposed between the cap and the movable armature and biases the movable contact to the fixed contact side, and the cap has a movement restriction part for restricting a movement of the contact pressure spring in a direction perpendicular to an axis direction of the contact pressure spring.

In this case, a displacement of the contact pressure spring is prevented by the movement restriction part, whereby it is possible to prevent a reduction of the contact pressure between the movable contact and the fixed contact resulted from the displacement (misalignment) of the contact pressure spring, and it is possible to increase reliability of the electromagnetic switching device.

Preferably, the movement restriction part is formed by cutting and bending a part of the cap. In this case, it is possible to easily increase a projecting size of the movement restriction part.

In the above case, it is preferable that the fixed core has a through hole through which the movable shaft passes, and the cap has, on a surface on the fixed core side, an annular isolation wall for isolating the through hole of the fixed core from a hole formed by forming the movement restriction part. In this case, it is possible to prevent that contact powder generated by the contact between the movable contact and the fixed contact enters the through hole of the fixed core through the hole of the cap and it interferes with the motion of the movable core.

Or, the cap may have an annular gutter-which projects to the fixed core side and into which one end of the contact pressure spring is fitted, and the gutter may provide the movement restriction part, and an outer bottom of the gutter may be in contact with the third cushioning member. In this case, it is possible to restrict the movement of the contact pressure spring by the annular gutter, and furthermore, because the outer bottom of the gutter is in contact with the third cushioning member, the contact area between the third cushioning member and the cap is reduced, whereby the transmission of the vibration generated in the electromagnetic device to the cap is suppressed, as a result, the transmission of the vibration to the case is suppressed.

Preferably, the contact device has a movable armature having the movable contact, a movable shaft whose one end is connected to the movable armature and the other end is connected to the movable core, and the electromagnetic device has a guide cylinder which is fixed to the fixed plate and houses the movable core movably, and the cap has a through hole through which the movable shaft passes, and the movable shaft is prevented from leaning by contact between the movable core and an inner surface of the guide cylinder and contact between the movable shaft and an inner surface of the through hole of the cap. In this case, as compared with a case where the lean of the movable shaft is prevented only by the inner surface of the guide cylinder, it is possible to prevent the lean of the movable shaft easily, and it is possible to prevent poor contact of the contact device due to the lean of the movable shaft, and it is possible to increase the reliability of the electromagnetic switching device.

By the way, in the conventional electromagnetic switching device, an end of the excitation coil is connected to a coil terminal, and the coil terminal is mechanically and electrically connected to an external terminal provided in the case. However, in a case where the electromagnetic device is held through the cushioning member in the case as the present invention, when the electromagnetic device held by the cushioning member vibrates in the case, the coil terminal held by the electromagnetic device also vibrates while the coil terminal and the external terminal are fixed to each other, so that each terminal becomes stressed, and poor contact and so on may occur.

So, in order to increase the reliability (resistance to vibration) of the electromagnetic switching device, it is preferable that the electromagnetic device has a coil terminal to which an end of the excitation coil is connected, and the case has an external terminal whose one end projects from the case to the outside and the other end projects inside the case, and the coil terminal and the external terminal are connected to each other by a connecting member having flexibility and made of a conductive material.

In this case, even when the electromagnetic device vibrates, it is possible to reduce the stress to be applied to the coil terminal and the external terminal by the connecting member having flexibility, and it is possible to increase the resistance to vibration of the electromagnetic switching device. Furthermore, because the vibration of the coil terminal is not directly transmitted to the external terminal, it is also possible to reduce the vibration to be transmitted from the electromagnetic device to the case.

Preferably, the connecting member is formed into a plate-like shape. In this case, it is possible to form the connecting member from widely diffused parts, so it is possible to lower the manufacturing cost.

In the above case, it is preferable that the connecting member comprises a plate-like first member having a surface orthogonal to a first direction (for example, a vertical direction), a plate-like second member having a surface orthogonal to a second direction (for example, a horizontal direction) perpendicular to the first direction, and a plate-like third member having a surface orthogonal to a third direction (for example, a back-and-forth direction) perpendicular to the first and second directions.

In this case, a vibration to each direction can be absorbed by bending of each member corresponding to each direction, whereby it is possible to increase the resistance to vibration.

When the connecting member has a plate-like shape, it is preferable that the connecting member has a junction part for welding at, at least, one of a position to be connected to the coil terminal and a position to be connected to the external terminal. In this case, it is possible to increase connection strength between the connecting member and the coil terminal and/or the external terminal.

The connecting member may be formed into a line-like shape. Or, the connecting member may be a strand of a plurality of elemental wires. In these cases, it is possible to lower the manufacturing cost and to increase the flexibility of the connecting member.

Preferably, the strand is coated by an insulating material. In this case, the strand is insulated, so it is possible to route the strand freely in the case.

Preferably, the coil terminal and the external terminal are disposed at positions opposite to each other in the case. In this case, it is possible to increase the length of the connecting member, so it is possible to absorb the vibration of the coil terminal sufficiently. Furthermore, by disposing the coil terminal and the external terminal apart from each other, it becomes easy to assemble the device.

The connecting member may be formed integrally with the coil terminal. In this case, it is possible to reduce the number of parts.

BEST MODE FOR CARRYING OUT THE INVENTION

Hereinafter, the present invention will be described in more detail with reference to the accompanying drawings.

In an embodiment below, although an encapsulated electromagnetic switching device, in which a contact device, a fixed core, and a movable core are housed in an airtight space, will be explained, the present invention can be applied to an electromagnetic switching device in which a contact device, a fixed core, and a movable core are not housed in a airtight space, of course.

Figure 1B:
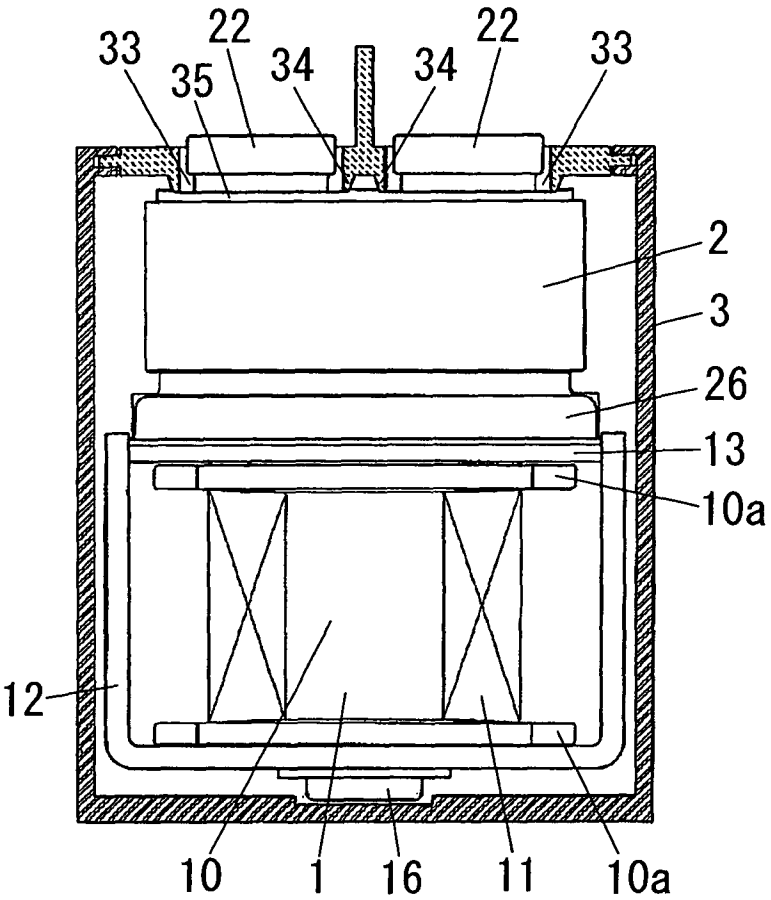
FIG. 1B is a cross-sectional front view of the electromagnetic switching device of FIG. 1A.
Figure 1A:
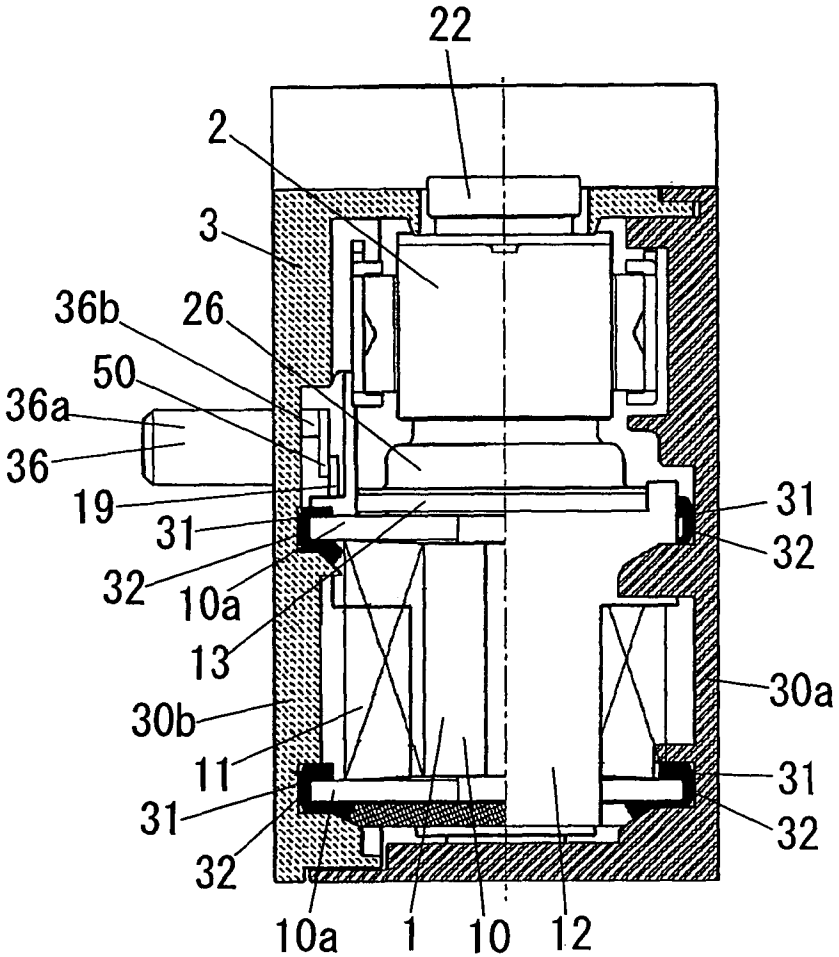
FIG. 1A is a cross-sectional side view of an electromagnetic switching device in accordance with an embodiment of the present invention.

As shown in FIGS. 1A and 1B, the electromagnetic switching device of this embodiment has an electromagnetic device 1, a contact device 2 which opens and closes contacts in conjunction with the movement of the electromagnetic device 1, and a case 3 for housing the electromagnetic device 1 and the contact device 2.

Figure 2:
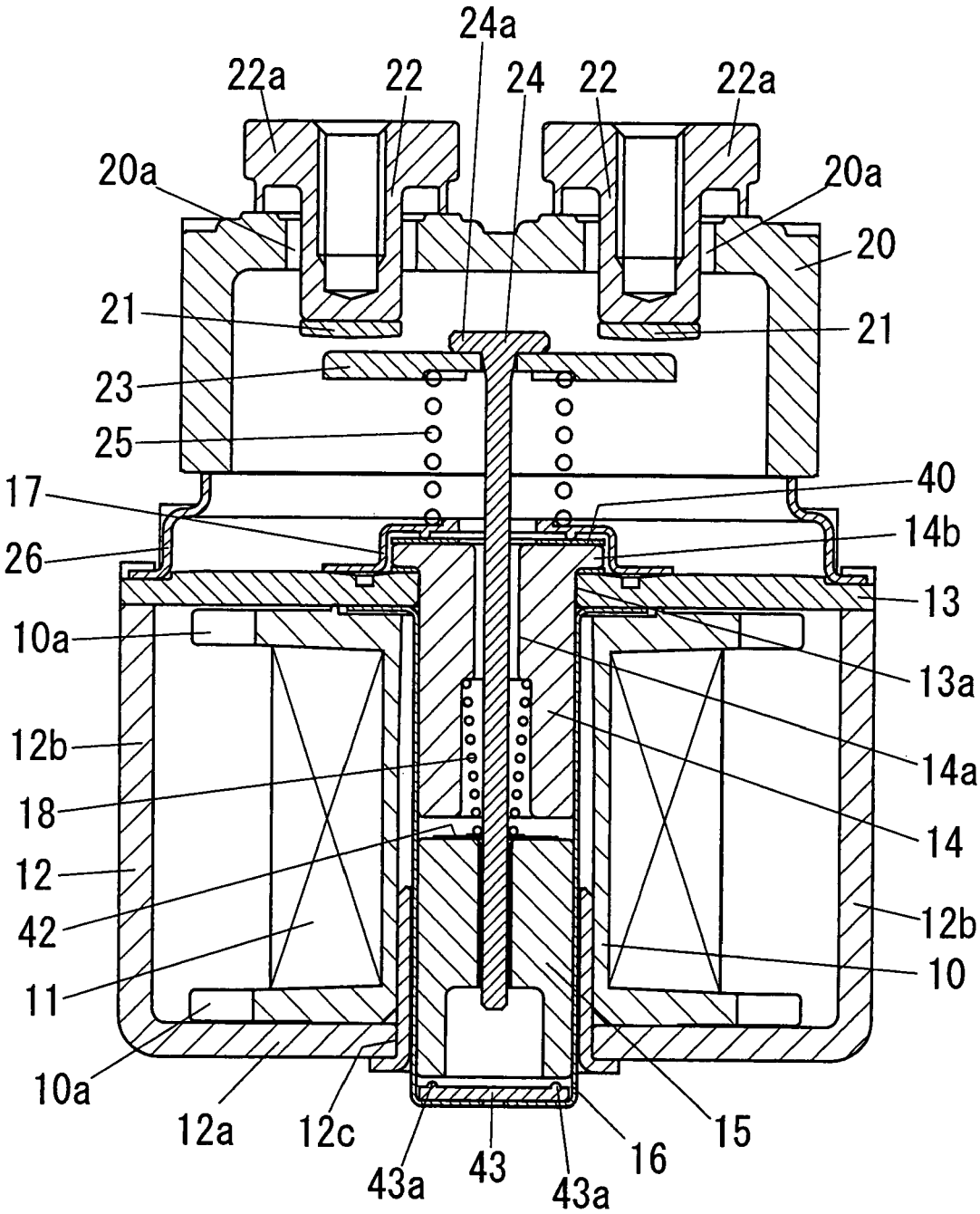
FIG. 2 is a cross-sectional view of an electromagnetic device and a contact device of the electromagnetic switching device of FIG. 1A.

As shown in FIG. 2, the electromagnetic device 1 comprises a cylindrical coil bobbin 10, an excitation coil 11 wound around the coil bobbin 10, a generally U-shaped yoke 12 in which the coil bobbin 10 is housed, a fixed plate 13 connected to both ends of the yoke 12, a guide cylinder 16 disposed in the coil bobbin 10, a cylindrical fixed core 14 housed in the inside of the guide cylinder 16, a cap 17 which is fixed to the fixed plate 13 so that it restricts the movement of the fixed core 14, and a movable core 15 which is movably housed in the guide cylinder 16 in a condition where it faces the fixed core 14.

The coil bobbin 10 is made from a synthetic resin and has a pair of flanges 10*a* at its both ends. Each flange 10*a* is formed into a rectangular plate-like shape. The excitation coil 11 is wound around the coil bobbin 10 between the pair of flanges 10*a*.

The yoke 12 comprises a center piece 12*a* and a pair of side pieces 12*b* upstanding from both ends of the center piece 12*a*. The yoke 12 has a through hole 12*c* at the center of the center piece 12*a* which communicates with the inside of the coil bobbin 10.

Figure 3:
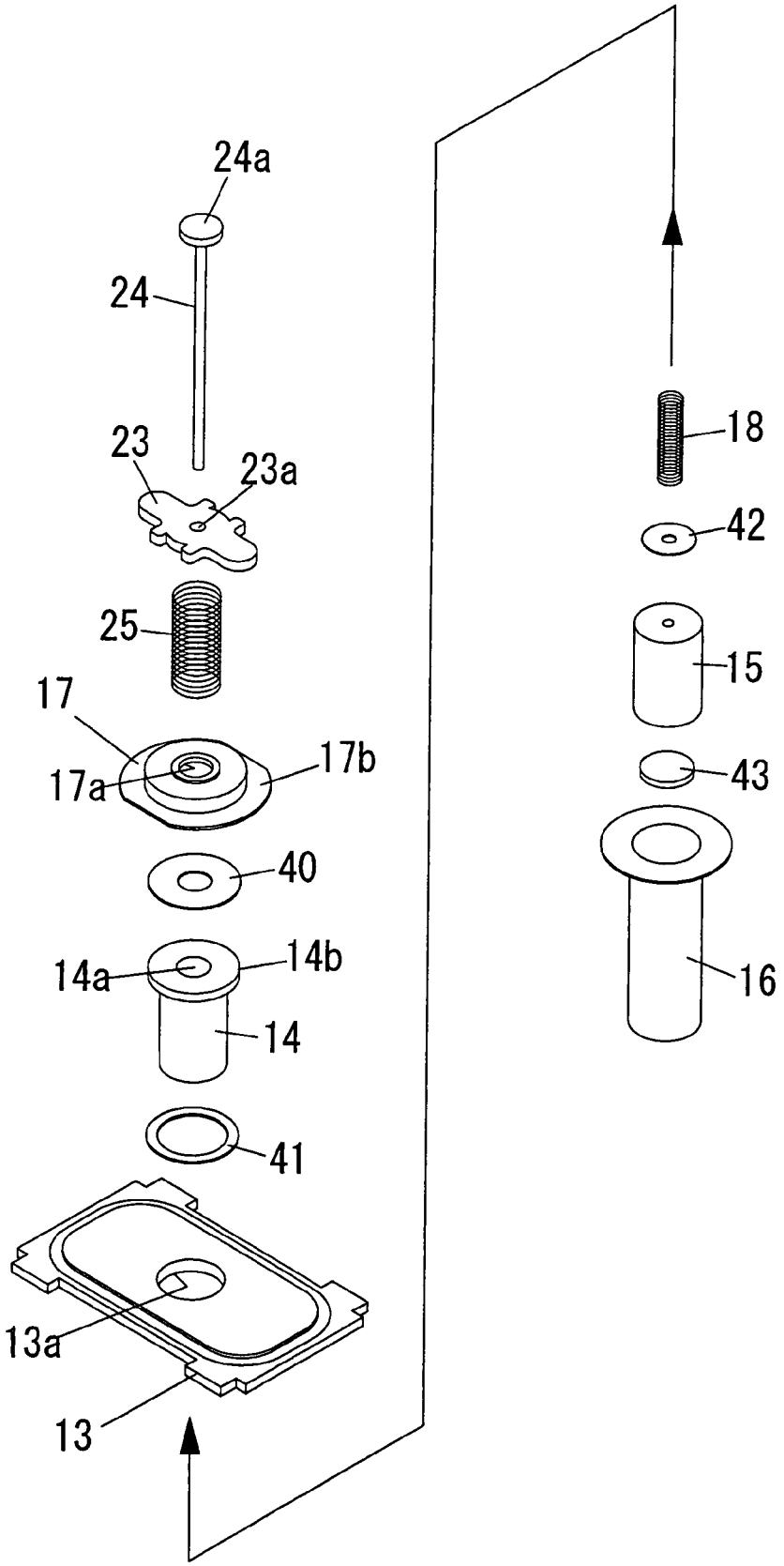
FIG. 3 is an exploded perspective view of a substantial part of the electromagnetic switching device of FIG. 1A.
Figure 4A:
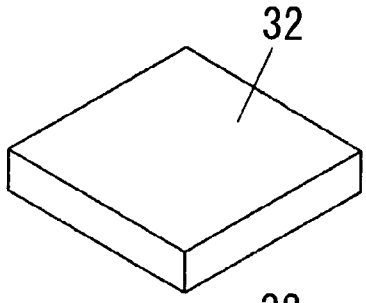
FIG. 4A is a perspective view showing another shape of a cushioning member used in the electromagnetic switching device of FIG. 1A.
Figure 4B:
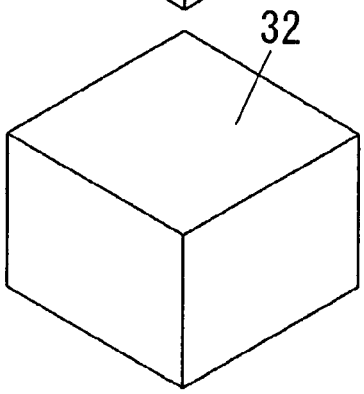
FIG. 4B is a perspective view showing another shape of the cushioning member used in the electromagnetic switching device of FIG. 1A.
Figure 4C:
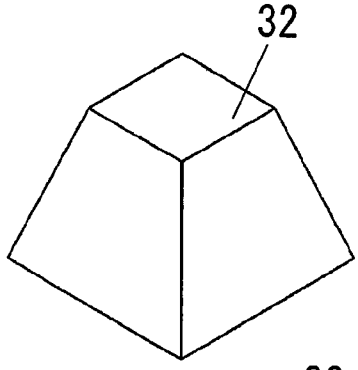
FIG. 4C is a perspective view showing another shape of the cushioning member used in the electromagnetic switching device of FIG. 1A.
Figure 4D:
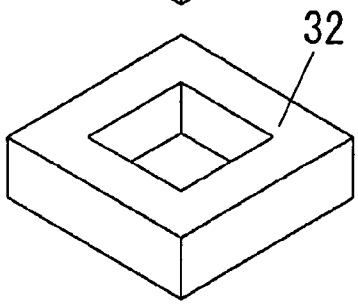
FIG. 4D is a perspective view showing another shape of the cushioning member used in the electromagnetic switching device of FIG. 1A.
Figure 4E:
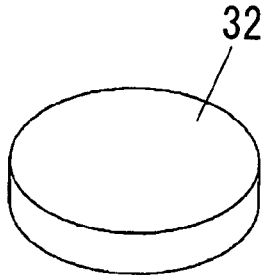
FIG. 4E is a perspective view showing another shape of the cushioning member used in the electromagnetic switching device of FIG. 1A.
Figure 4F:
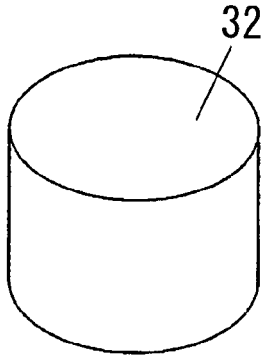
FIG. 4F is a perspective view showing another shape of the cushioning member used in the electromagnetic switching device of FIG. 1A.
Figure 4G:
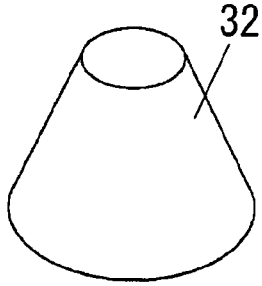
FIG. 4G is a perspective view showing another shape of the cushioning member used in the electromagnetic switching device of FIG. 1A.
Figure 4H:
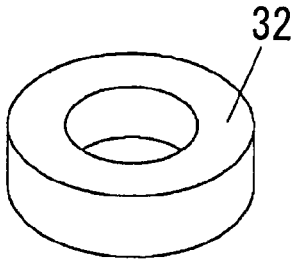
FIG. 4H is a perspective view showing another shape of the cushioning member used in the electromagnetic switching device of FIG. 1A.
Figure 5A:
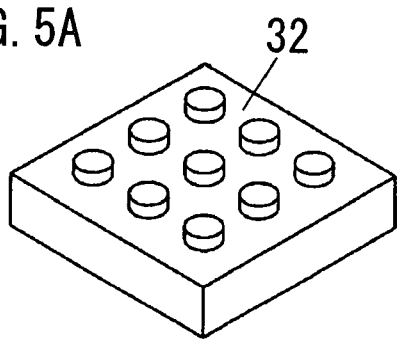
FIG. 5A is a perspective view showing another configuration of the cushioning member used in the electromagnetic switching device of FIG. 1A.
Figure 5B:
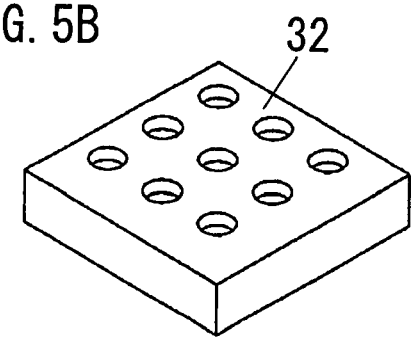
FIG. 5B is a perspective view showing another configuration of the cushioning member used in the electromagnetic switching device of FIG. 1A.
Figure 5C:
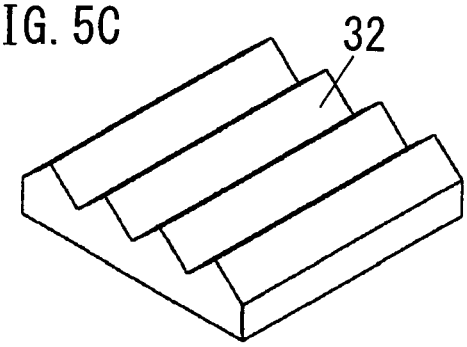
FIG. 5C is a perspective view showing another configuration of the cushioning member used in the electromagnetic switching device of FIG. 1A.
Figure 5D:
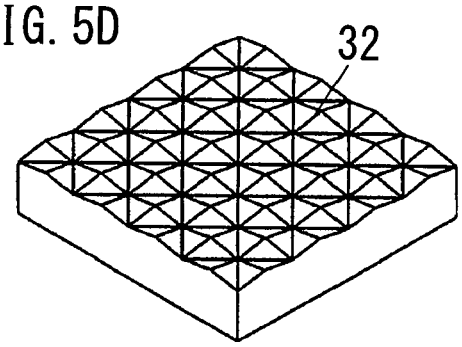
FIG. 5D is a perspective view showing another configuration of the cushioning member used in the electromagnetic switching device of FIG. 1A.

As shown in FIG. 3, the fixed plate 13 is made of a magnetic metal material, and is formed into a generally rectangular shape, and it has a through hole 13*a* at its center through which one end of the fixed core 14 can pass. The fixed plate 13 is connected to both ends of the side pieces 12*b* of the yoke 12 so that it closes between the ends of the side pieces 12*b*.

The guide cylinder 16 is made from a non-magnetic material and is formed into a cylindrical shape having a bottom, and it is disposed inside the coil bobbin 10, and an opening of the guide cylinder 16 is hermetically connected to a periphery of the through hole 13*a* of the fixed plate 13, and the bottom of it projects from the through hole 12*c* of the yoke 12 to the outside.

One end (a cylindrical part) of the fixed core 14 has an outside diameter which is almost equal to an inside diameter of the guide cylinder 16 and is capable of passing through the through hole 13*a* of the fixed plate 13, and the other end of the fixed core 14 has a flange 14*b*. The flange 14*b* is locked to the periphery of the through hole 13*a* of the fixed plate 13 while the cylindrical part of it passed through the through hole 13*a* of the fixed plate 13, whereby the fixed core 14 is disposed inside the guide cylinder 16 on the fixed plate 13 side.

The cap 17 is made of a metal plate, and is formed into a cylindrical shape having a bottom, and it has a flange 17*b* around an opening of it, and has a through hole 17*a* at the bottom. The cap 17 is disposed on the fixed plate 13 so that it covers the flange 14*b* of the fixed core 14, and the flange 17*b* is fixed to the fixed plate 13.

The movable core 15 has an outside diameter which is almost equal to an inside diameter of the guide cylinder 16, and the movable core 15 is movably housed inside the guide cylinder 16 in the condition where it faces the fixed core 14. A return spring 18, which is a coil spring, is disposed between the movable core 15 and the fixed core 14 so as to bias the movable core 15 in a direction away from the fixed core 14, and the movable core 15 is separate from the fixed core 14 at a predetermined distance. The movable core 15 makes magnetic coupling with the periphery of the through hole 12*c* of the yoke, and the movable core 15, the fixed core 14, the fixed plate 13, and the yoke 12 make a magnetic path for passing a magnetic flux generated from the excitation coil 11.

The contact device 2 comprises a base block 20, a pair of fixed terminals 22 each of which has a fixed contact 21, a movable armature 23 with a pair of movable contacts (not shown) which come into contact with or separate from the pair of fixed contacts 21, a movable shaft 24 whose one end is connected to the movable armature 23 and the other end is connected to the movable core 15.

The base block 20 is made from a heat-resistant material and is formed into a box shape whose one side is opened, and it has two through holes 20*a* at its bottom.

Each fixed terminal 22 is made from a copper series material and is formed into a cylindrical column shape, and it has the fixed contact at one end and has a flange 22*a* at the other end. One end of each of the fixed terminals 22 is inserted into the inside of the base block 20 through the through hole 20*a* of the base block 20, and the flange 22*a* is hermetically connected to the outer bottom of the base block 20 by, for example, brazing.

The movable armature 23 is made from a conductive material and is formed into a flat plate-like shape. The pair of movable contacts is fixed to a position facing the pair of fixed contacts 21. The movable armature 23 has a through hole 23*a* into which the movable shaft 24 is inserted, at its center.

The movable shaft 24 is made from an insulating material and is formed into a generally round bar shape. The movable shaft 24 has a flange 24*a* for preventing a drop of the armature 3 at one end, and the other of the movable shaft 24 is connected to the movable core 15 through the through hole 23*a* of the movable armature 23, the through hole 17*a* of the cap 17, and the through hole 14*a* of the fixed core 14.

A contact pressure spring 25, which is a coil spring, is disposed between the movable armature 23 and the cap 17, and the movable armature 23 is pushed (biased) to the fixed contact 21 side by the spring force of the contact pressure spring 25, and is pressed against the flange 24*a* of the movable shaft 24.

The base block 20 is connected to the fixed plate 13 through a joining member 26. The joining member 26 is made form a metallic material and is formed into a cylindrical shape, and one opening of it is hermetically connected to. the opening of the base block 20, and the other opening of it is hermetically connected to the fixed plate 13. As a result, an airtight space surrounded by the base block 20, the fixed terminals 22, the joining member 26; the fixed plate 13, and the guide cylinder 16 is formed. In order to extinguish an arc which arose between the fixed contacts 21 and the movable contacts in a small amount of time, gas mainly comprising hydrogen is encapsulated inside the airtight space at about 2 atmospheric pressures.

The electromagnetic switching device of this embodiment constituted as above works as bellow.

In an initial state, the movable contacts and the fixed contacts 21 are separate from each other by a predetermined distance, and the movable core 15 and the fixed core 14 are also separate from each other by a predetermined distance.

When the excitation coil 11 is energized, the movable core 15 is attracted to the fixed core 14 and moves thereto. As a result, the movable shaft 24 connected to the movable core 15 moves to the fixed terminal 21 side, whereby the movable contacts come in contact with the fixed contacts 21. By this, the fixed terminals 22 are brought into conduction with each other. After that, the movable core 15 over-travels and comes in contact with the fixed core 14. The contact pressure between the movable contacts and the fixed contacts 21 are secured by the contact pressure spring 25.

When the energization of the excitation coil 11 is stopped, the movable armature 23 moves in a reverse direction by a spring force of the return spring 18. As a result, the movable contacts are separated from the fixed contacts 21, and the fixed terminals 22 are insulated from each other. The movable core 15 is also separated from the fixed core 14, and the electromagnetic switching device returns to the initial state.

As shown in FIG. 1A, the case 3 is formed into a box shape by assembling a body 30*a* and a cover 20*b* which are separable from each other in a horizontal direction of FIG. 1A. The electromagnetic device 1 and the contact device 2 are housed in the case 3 when the body 30*a* and the cover 30*b* are assembled.

The case 3 has a recess 31 into which peripheries of both flanges 10*a* of the coil bobbin 10 are fitted, on the inner surface thereof in the horizontal direction of FIG. 1A. In this embodiment, an upside of the upper recess 31 in FIG. 1A is opened.

A cushioning member 32 for absorbing an impact to be transmitted from the electromagnetic device 1 to the case 3 is disposed in each recess 31, and each flange 10*a* of the coil bobbin 10 is supported by the recess 31 through the cushioning member 32.

The cushioning member 32 is made of a raw material having many air spaces therein, and the impact to be transmitted from the electromagnetic device 1 to the case 3 repeats an input motion, a propagation motion, and an output motion among many air spaces, and it is attenuated when it enters and goes out of the air spaces. By this, it is possible to reduce the impact to be transmitted from the electromagnetic device 1 to the case 3 with a high degree of efficiency.

Concretely speaking, it is preferable that the cushioning member 32 is formed by stacking a plurality of fine materials formed into a cloth shape or a nonwoven fabric shape. In this case, the impact repeats the input, motion, the propagation motion, and the output motion among the stacked fine materials, and it is attenuated when it enters and goes out of the fine materials, whereby it is possible to reduce the impact to be transmitted from the electromagnetic device 1 to the case 3 with a high degree of efficiency. Or, a sponge may be used as the cushioning member on the same principle.

Or, a synthetic rubber, a synthetic resin, or a metallic material formed into a spring shape or a fabric shape may be used as the cushioning member 32. It is preferable to use, as the cushioning member, a material having a heat resistance higher than or equal to that of the coil bobbin 10, which has the lowest heat resistance among the electromagnetic device 1, the contact device 2, and the case 3 so that the heat resistance of the whole electromagnetic switching device may not be reduced due to the cushioning member 32. Furthermore, it is preferable that the cushioning member 32 is made of a material which can absorb vibration energy more than the coil bobbin made from a synthetic resin when a material is deformed.

As shown in FIGS. 4A to 4H, the shape of the cushioning member 32 may be a rectangular shape, a frustum shape, a frame shape, a cylindrical column shape, or a cylinder shape. Or, the shape of the cushioning member 32 may be a sphere shape (not shown). Furthermore, as shown in FIGS. 5A to 5D, a surface of the cushioning member 32 which is in contact with the case 3 and/or the flange 10*a* may have protrusions or recesses. In this case, a contact area between the cushioning member 32 and the case 3 and/or the flange 10 is reduced, whereby it becomes easy for the coil, bobbin 10 to move with respect to the case 3 relatively, and the energy (the vibration) to be transmitted to the case 3 is reduced. Conversely, protrusions or recesses may be formed on the flange 10*a* and the case 3 which are in contact with the cushioning member 32.

As mentioned above, in the electromagnetic switching device of this embodiment, because the electromagnetic device 1 is supported by the recess 31 of the case 3 through the cushioning member 32, the vibration generated in the electromagnetic device 1 is not transmitted to the case 3 directly, and it is absorbed by the cushioning member 32. Therefore, the vibration generated in the electromagnetic device 1 is not easily transmitted to the case 3, whereby it is possible to reduce the vibration to be transmitted from the electromagnetic device 1 to the case 3. Furthermore, because the coil bobbin 10 is not directly connected to the movable core 15 and the fixed core 15, which are the source of the impact, but it is indirectly connected to them through the yoke 12 and so on, even if an impact occurs when the movable core 15 hit against the fixed core 14, the impact is not easily transmitted to the coil bobbin 10. Still furthermore, because the coil bobbin is made from a synthetic resin, it hardly transmits the impact generated in the electromagnetic device 1. Therefore, by supporting such a flange of the coil bobbin, it is possible to reduce the impact to be transmitted from the electromagnetic device 1 to the case more.

Figure 6A:
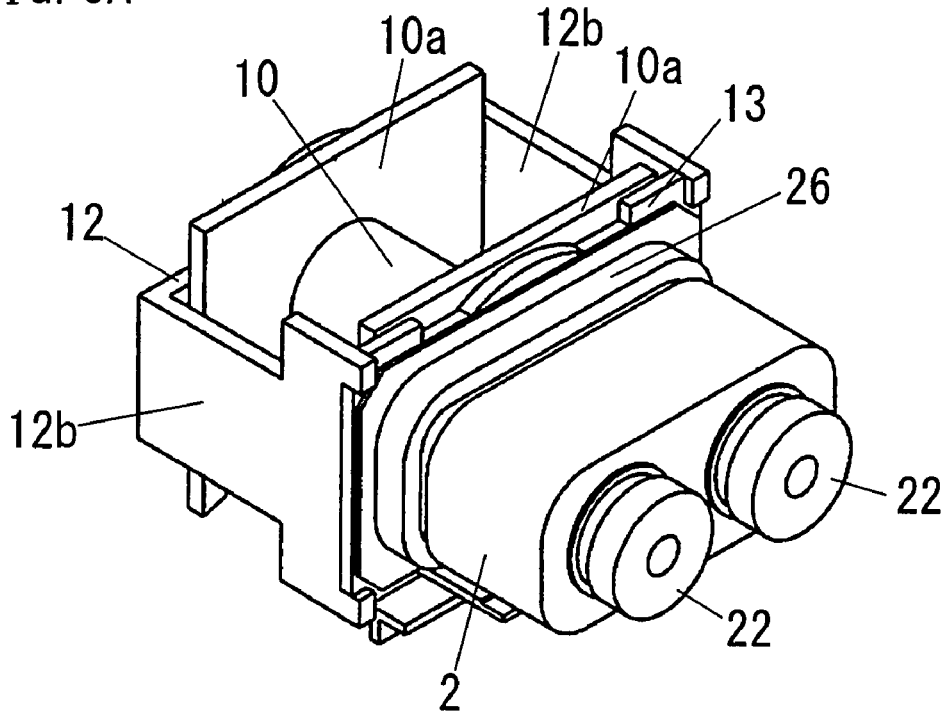
FIG. 6A is a perspective view for explaining a shape of a flange of a coil bobbin used in the electromagnetic switching device of FIG. 1A.
Figure 6B:
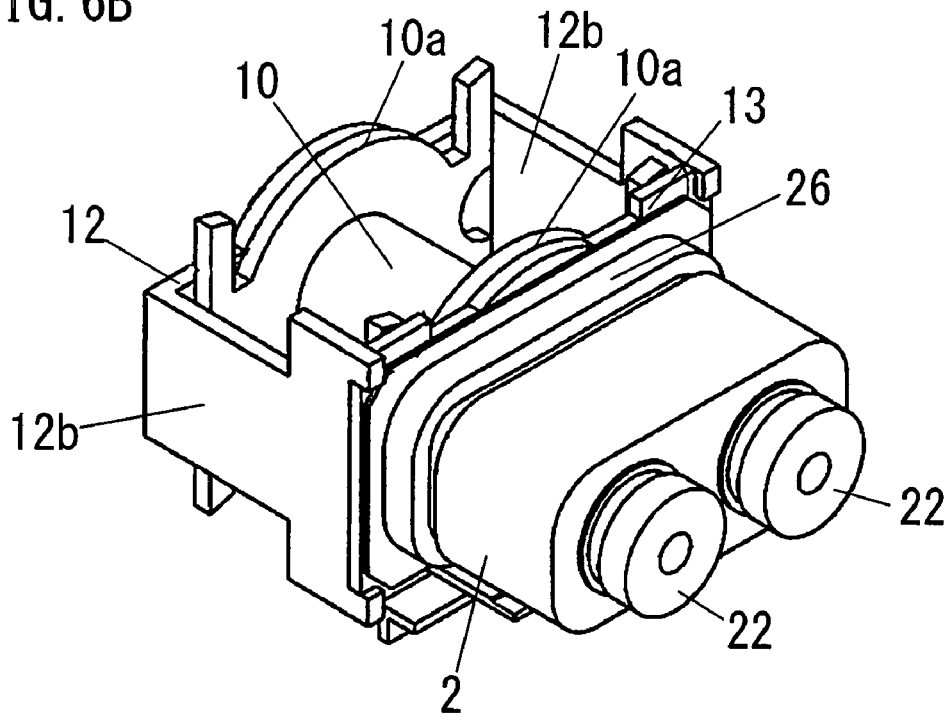
FIG. 6B is a perspective view showing another shape of the flange of the coil bobbin used in the electromagnetic switching device of FIG. 1A.

Although the flange 10*a* of the coil bobbin 10 of this embodiment has a rectangular shape as shown in FIG. 6A, a part of the flange which is held by the case 3 may be formed into a round shape as shown in FIG. 6B. In this case, the contact area between the flange 10*a* and the cushioning member 32 is reduced, whereby it becomes easy for the flange 10*a* to move with respect to the case 3, so, even if impact occurs in the electromagnetic device 1, the transmission of the impact to the case 3 is more suppressed.

As shown in FIG. 1B, the case 3 of this embodiment has terminal windows 33 for exposing the fixed terminals 22 to the outside, and a rib 34 is provided from the periphery of each terminal window 33 toward the contact device 2 so that it surrounds the fixed terminal 22, and a second cushioning member 35 is provided so that it fills a gap between the periphery of the terminal windows (in other words, the inner surface of the rib 34) and the contact device 2. The front edge of the rib 34 is in contact with the contact device 2 through the second cushioning member 35. By providing the second cushioning member 35, it is possible to prevent an entry of a foreign object into the case 3 through the terminal window 33. Furthermore, because the case 3 is in contact with the contact device 2 through the second cushioning member 35, the vibration generated in the electromagnetic device 1 is also absorbed by the second cushioning member 35, whereby the transmission of the impact to the case 3 is more suppressed.

By the way, in the electromagnetic switching device of this embodiment, the transmission of the vibration to the case 3 is also reduced by suppressing the vibration itself generated in the electromagnetic device 1. A constitution for suppressing the vibration which is generated in the electromagnetic device 1 will be explained below.

Figure 7:
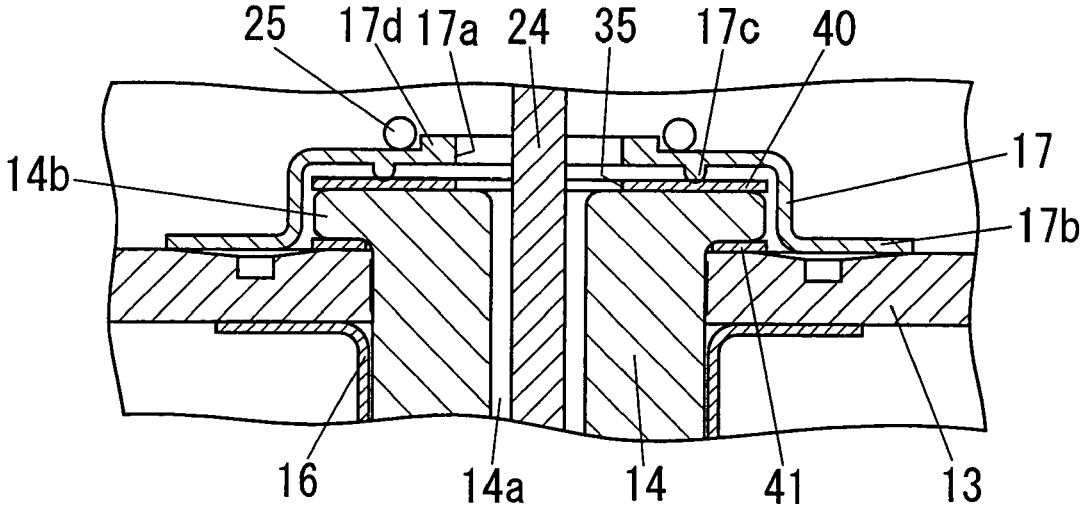
FIG. 7 is a view for explaining a substantial part of the electromagnetic switching device of FIG. 1A.

FIG. 7 is an enlarged view of a substantial part of the fixed core 14 and the cap 17 of the electromagnetic switching device 1. As shown in FIG. 7, in this embodiment, a circular (or, annular) rubber sheet 40 (a third cushioning member) made of a material having elasticity, such as a synthetic rubber, is provided between the flange 14*b* of the fixed core 14 and the bottom of the cap 17. Furthermore, as shown in FIG. 3, another circular (or, annular) rubber sheet 41 is provided between the flange 14*b* of the fixed core 14 and the fixed plate 13. Still furthermore, another circular (or, annular) rubber sheet 42 is provided between the movable core 15 and the fixed core 14, and a damper rubber 43 having a dowel (see FIG. 2) on a surface on the movable core 15 side is provided between the bottom of the guide cylinder 16 and the movable core 15.

By providing the rubber sheet 40 between the flange 14*b* of the fixed core 14 and the bottom of the cap 17, the impact generated when the movable core 15 hit the fixed core 14 is absorbed by the rubber sheet 40, whereby the impact itself which is generated in the electromagnetic device can be suppressed. Similarly, by providing the rubber sheet 42 between the movable core 15 and the fixed core 14, too, the impact generated when the movable core 15 hit the fixed core 14 can be absorbed. Furthermore, by providing the rubber sheet 41 between the flange 14*b* of the fixed core 14 and the fixed plate 13 and providing the damper rubber 43 between the guide cylinder 16 and the movable core 15, the impact which is generated when the movable core 15 returns to the initial position can be absorbed.

As shown in, FIG. 7, the cap 17 of this embodiment has a support protrusion 17*c* on a surface facing the rubber sheet 40 (the third cushioning member), and the front edge of the support protrusion 17*c* is in contact with the rubber sheet 40 (the third cushioning member). In this case, as compared with a case where the support protrusion 17*c* is not provided, pressure which is applied to a portion of the rubber sheet 40 which is in contact with the support protrusion 17*c* becomes higher, and as a result, the amount of deformation of the portion of the rubber sheet 40 which is in contact with the support protrusion 17*c* is increased, whereby it is possible to efficiently absorb the impact which is generated when the movable core hits the fixed core.

Figure 8A:
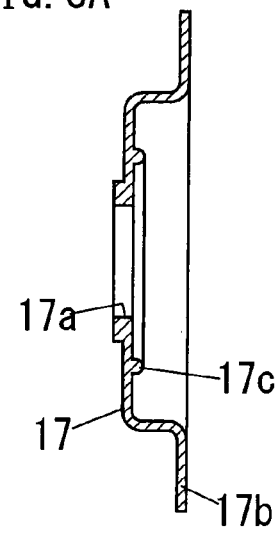
FIG. 8A is a cross-sectional view of a cap used in the electromagnetic switching device of FIG. 1A.
Figure 8B:
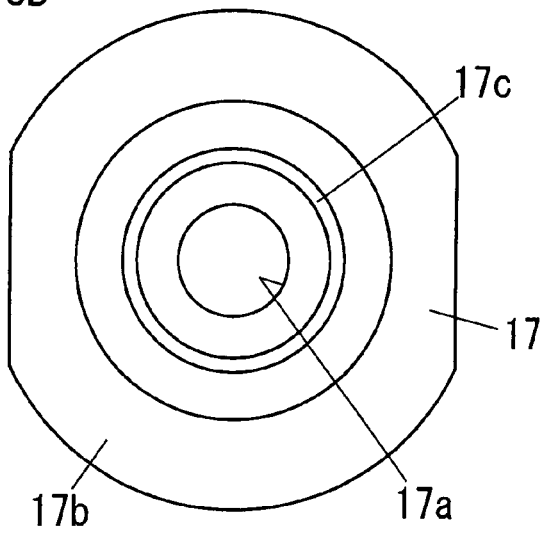
FIG. 8B is a plan view of the cap used in the electromagnetic switching device of FIG. 1A.
Figure 8C:
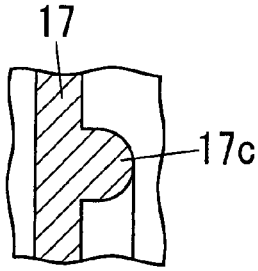
FIG. 8C is a cross-sectional view of a substantial part of the cap used in the electromagnetic switching device of FIG. 1A.

As shown in FIGS. 8A and 8B, the support protrusion 17*c* of FIG. 7 is formed into an annular shape around the center axis of the fixed core 14. In this case, it is possible to reduce the impact to be transmitted from the fixed core 14 to the cap 17 through the rubber sheet 40 evenly along an annular shape around the center axis of the fixed core 14. Furthermore, as shown in FIG. 8C, the end of the support protrusion 17*c* is formed into a curved surface which projects to the rubber sheet 40 (the third cushioning member) side. By this, the pressure which is applied to the portion of the rubber sheet 40 which is in contact with the support protrusion 17*c* becomes much higher, whereby it is possible to efficiently absorb the impact which is generated when the movable core 15 hits the fixed core 14. Furthermore, because the contact area between the support protrusion 17*c* and the rubber sheet 40 decreases, the transmission of the impact is suppressed.

Figure 9:
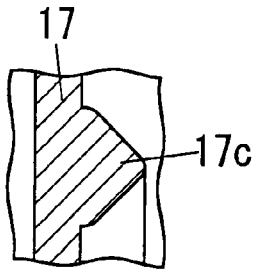
FIG. 9 is a cross-sectional view showing another shape of the substantial part of the cap used in the electromagnetic switching device of FIG. 1A.

As shown in FIG. 9, as a substitute for the shape of the support protrusion 17*c* shown in FIG. 8C, the end of the support protrusion 17*c* may be tapered toward the rubber sheet 40 (the third cushioning member) side. In this case, too, the pressure which is applied to the rubber sheet 40 which is in contact with the support protrusion 17*c* becomes higher, whereby it is possible to efficiently absorb the impact which is generated when the movable core 15 hits the fixed core 14. Furthermore, because the contact area between the support protrusion 17*c* and the rubber sheet 40 decreases, the transmission of the impact is suppressed.

Figure 10A:
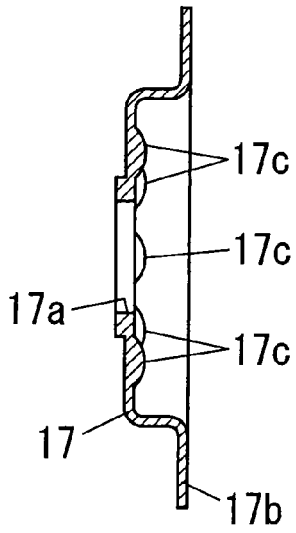
FIG. 10A is a cross-sectional view showing another shape of the cap used in the electromagnetic switching device of FIG. 1A.
Figure 10B:
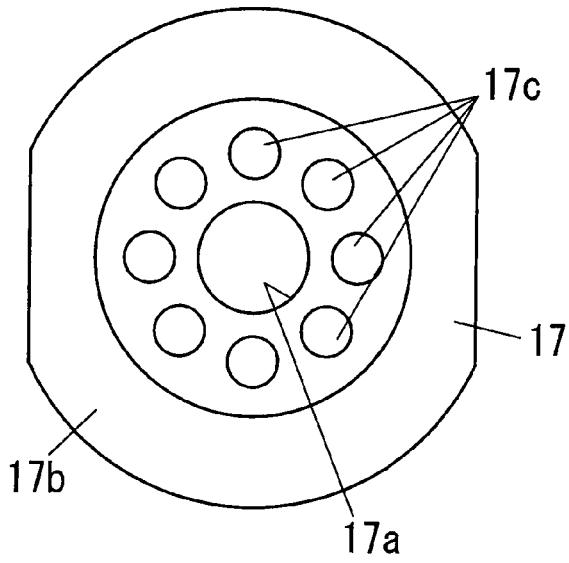
FIG. 10B is a plan view showing another shape of the cap used in the electromagnetic switching device of FIG. 1A.

As shown in FIGS. 10A and 10B, as a substitute for the annular support protrusion 17*c*, the support protrusions 17*c* may be formed on parts of the annular shape around the center axis of the fixed core 14. In this case, as compared with the case where the support protrusion 17*c* is formed into the annular shape, the pressure applied to the rubber sheet 40 is concentrated to the portion in which the support protrusions 17*c* are formed. As a result, the amount of deformation of the portion of the rubber sheet 40 which is in contact with the support protrusion 17*c* is increased, whereby it is possible to efficiently absorb the impact which is generated when the movable core hits the fixed core. Furthermore, because the contact area between the support protrusion 17*c* and the rubber sheet 40 decreases, the transmission of the impact is suppressed.

Figure 11A:
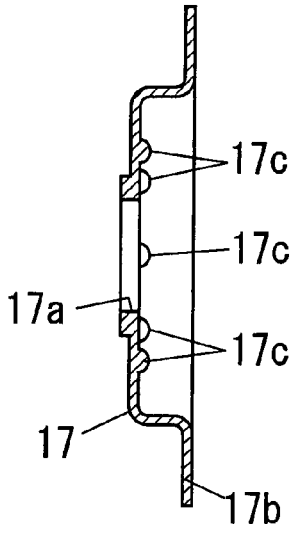
FIG. 11A is cross-sectional view showing another shape of the cap used in the electromagnetic switching device of FIG. 1A.
Figure 11B:
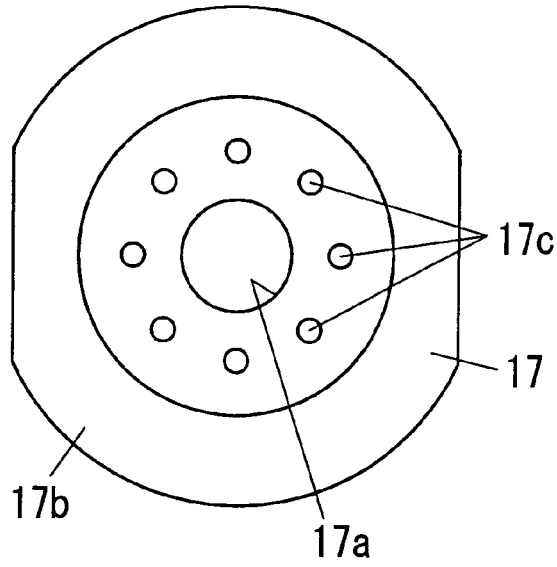
FIG. 11B is a plan view showing another shape of the cap used in the electromagnetic switching device of FIG. 1A.
Figure 12A:
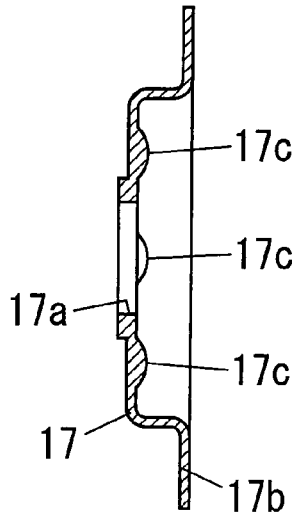
FIG. 12A is cross-sectional view showing another shape of the cap used in the electromagnetic switching device of FIG. 1A.
Figure 12B:
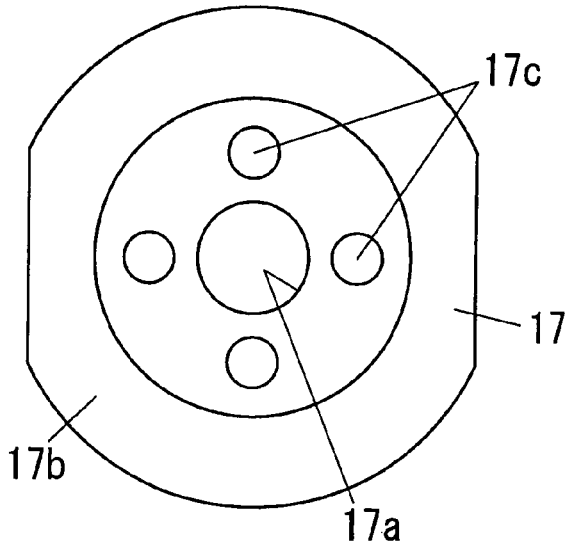
FIG. 12B is a plan view showing another shape of the cap used in the electromagnetic switching device of FIG. 1A.

The size of the support protrusion 17*c* is not particularly limited. For example, as shown in FIGS. 11A and 11B, the size of the support protrusion 17*c* may be made smaller as compared with FIGS. 10A and 10B. And, the number of the support protrusions 17*c* is not also particularly limited. For example, as shown in FIG. 12A and 12B, the number of the support protrusions 17*c* may be reduced, as compared with FIGS. 10A and 10B.

Figure 13A:
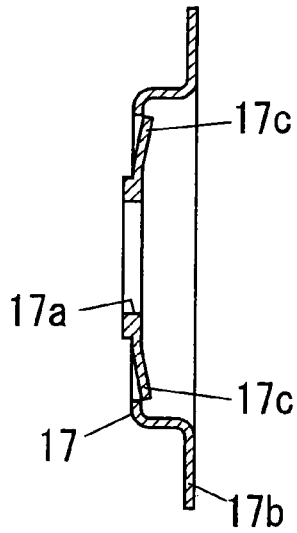
FIG. 13A is cross-sectional view showing another shape of the cap used in the electromagnetic switching device of FIG. 1A.
Figure 13B:
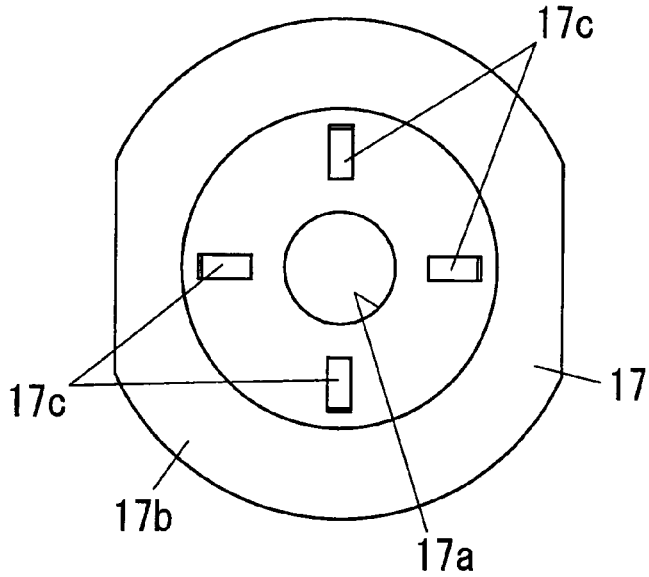
FIG. 13B is a plan view showing another shape of the cap used in the electromagnetic switching device of FIG. 1A.

As shown in FIGS. 13A and 13B, it is preferable that the support protrusion 17*c* is formed by cutting the metal plate of the bottom of the cap 17 and bending it toward the rubber sheet 40 side so as to give the support protrusion 17*c* flexibility in the axis direction of the fixed core 14. In this case, the support protrusion 17*c* acts as a leaf spring, and not only the rubber sheet (the third cushioning member) 40 but also the support protrusion 17*c* can absorb the impact generated when the movable core hits the fixed core, whereby the transmission of the impact generated in the electromagnetic device to the cap is more suppressed. As a result, the vibration to be transmitted to the case 3 can be reduced.

Figure 14:
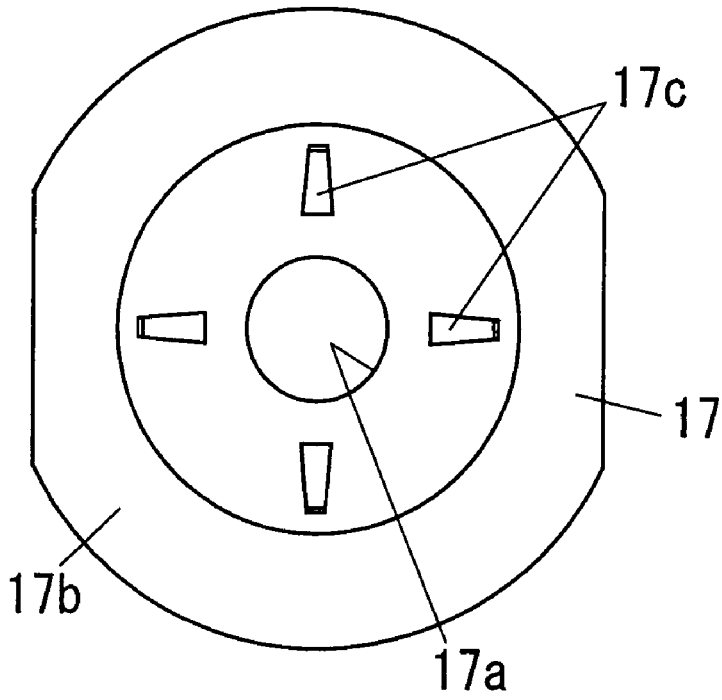
FIG. 14 is a plan view showing another shape of the cap used in the electromagnetic switching device of FIG. 1A.

As shown in FIG. 14, the support protrusion 17*c* may be tapered toward the top. In this case, the contact area between the support protrusion 17*c* and the rubber sheet 40 is reduced, and the amount of deformation of the rubber sheet which is in contact with the support protrusion 17*c* is increased, whereby it is possible to absorb the impact generated when the movable core 15 hits the fixed core 14 more. Furthermore, because the contact area between the support protrusion 17*c* and the rubber sheet 40 is reduced, the transmission of the impact is more suppressed.

Figure 15A:
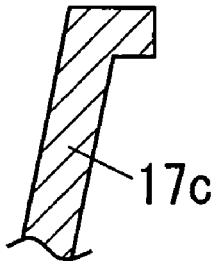
FIG. 15A is an enlarged sectional view of a substantial part of the cap of FIG. 13A or FIG. 14.
Figure 15B:
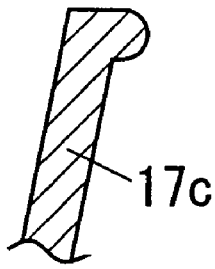
FIG. 15B is an enlarged sectional view of a substantial part of the cap of FIG. 13A or FIG. 14.
Figure 15C:
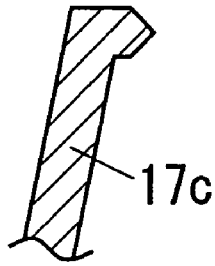
FIG. 15C is an enlarged sectional view of a substantial part of the cap of FIG. 13A or FIG. 14.

As shown in FIG. 15A, the top of the support protrusion 17*c* may be bent toward the rubber sheet 40 (the third cushioning member) side. In this case, it is possible to reduce the contact area between the support protrusion 17*c* and the rubber sheet 40 more. Furthermore, as shown in FIGS, 15B and 15C, the end of the bent top may be formed into a curved surface, or may be tapered. In this case, the contact area between the support protrusion and the rubber sheet 40 can be reduced more.

Figure 16A:
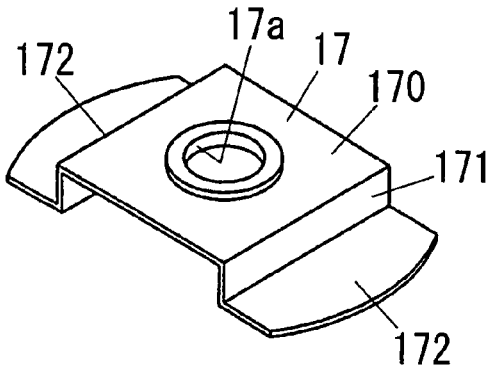
FIG. 16A is a perspective view showing another configuration of the cap used in the electromagnetic switching device of FIG. 1A.
Figure 16B:
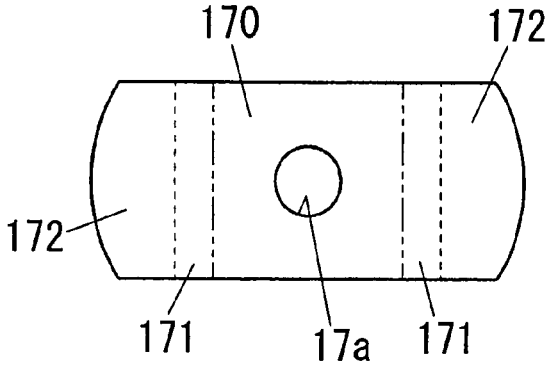
FIG. 16B is a developed view of the cap of FIG. 16A.

By the way, the cap 17 of this embodiment is formed by a drawing process of a metal plate. However, when using the drawing process, the cost for manufacturing the cap 17, such as an investment in equipment necessary for the process and an investment in a die, is increased. So, as shown in FIG. 16A, the cap 17 may be formed by a bending process from a metal plate shown in FIG. 16B. The cap 17 of FIG. 16A comprises a rectangular main wall 170 which covers the end face of the flange 14*b* of the fixed core 14, a pair of side walls 171 which are formed by bending both ends (a pair of ends) of the main wall 170 toward the flange 14 side and cover the side surface of the flange 14*b*, and a fixed parts 172 which are formed by bending an end of each side wall 171 and are fixed to the fixed plate 13. The main wall 170 has a through hole 17*a*. In this case, equipment and a die for the drawing process become unnecessary, so it is possible to lower the cost for manufacturing the cap 17.

Figure 17A:
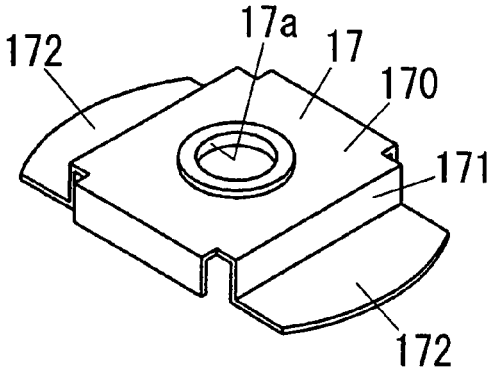
FIG. 17A is a perspective view showing another configuration of the cap used in the electromagnetic switching device of FIG. 1A.
Figure 17B:
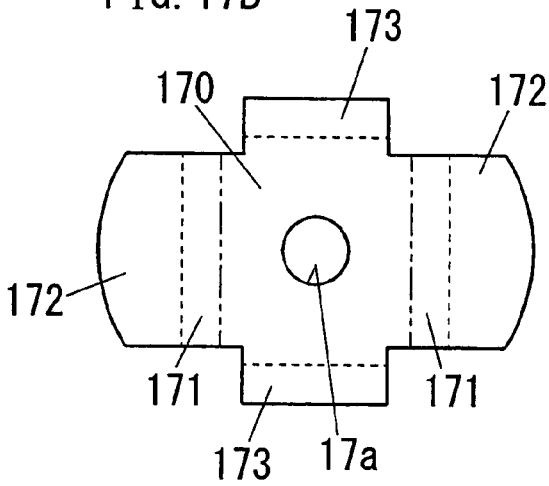
FIG. 17B is a developed view of the cap of FIG. 17A.
Figure 18A:
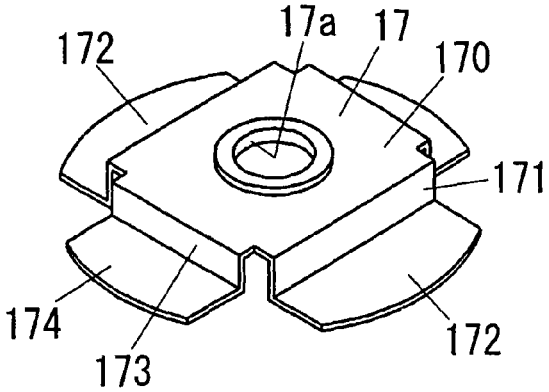
FIG. 18A is a perspective view showing another configuration of the cap used in the electromagnetic switching device of FIG. 1A.
Figure 18B:
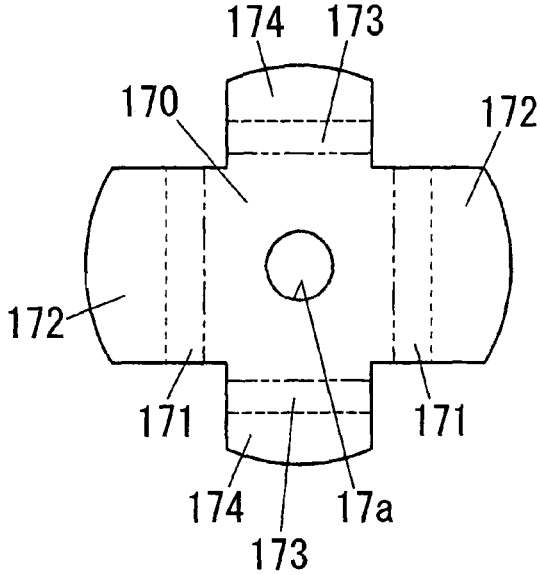
FIG. 18B is a developed view of the cap of FIG. 18A.
Figure 19A:
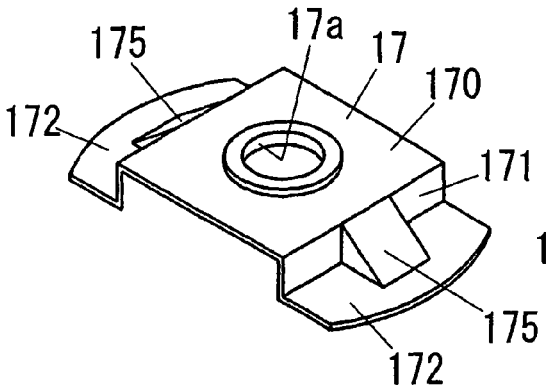
FIG. 19A is a perspective view showing another configuration of the cap used in the electromagnetic switching device of FIG. 1A.
Figure 19B:
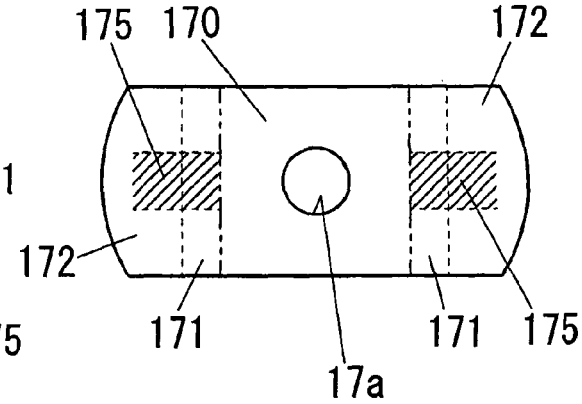
FIG. 19B is a developed view of the cap of FIG. 19A.

As shown in FIGS. 17 and 17B, the cap 17 of FIG. 16A may further have reinforcing walls 173 which are formed by bending the other pair of ends of the main wall 170 toward the flange 14*b* side and whose ends are in contact with the fixed plate 13. In this case, the strength of the cap 17 is increased, and it is possible to prevent deformation of the cap 17 resulting from an external force. Furthermore, as shown in FIGS. 18A and 18B, the end of each reinforcing wall 173 may be bent outward at 90-degree angle to form a welding part 174 which is to be welded to the fixed plate 13. In this case, it is possible to weld the welding part 174 to the fixed plate 13, whereby it is possible to increase the strength of the cap 17 more. Furthermore, as shown in FIGS. 19A and 19B, it is preferable that the cap 17 of FIG. 16A has connection parts 175 for connecting between each side wall 171 and each fixed part 172. In this case, it is possible to further increase the strength of the cap 17, and it is possible to stabilize the shape of the side wall and the fixed part.

Figure 20A:
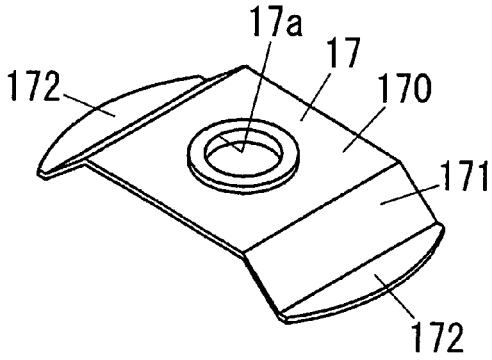
FIG. 20A is a perspective view showing another configuration of the cap used in the electromagnetic switching device of FIG. 1A.
Figure 20B:
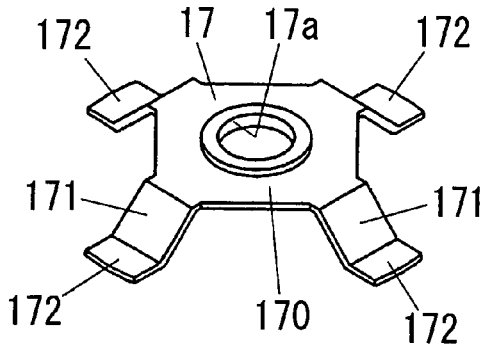
FIG. 20B is a perspective view showing another configuration of the cap used in the electromagnetic switching device of FIG. 1A.

Although, in the cap 17 of FIG. 16A, the main wall 170 and the side wall 171 intersect at right angles, the main wall 170 and the side wall 171 may intersect at obtuse angle, as shown in FIG. 20A. Furthermore, as shown in FIG. 20B, the side walls 171 may be formed at four corners of the main wall 170, and the side walls 171 may be bent so that the angle which the main wall 170 forms with each side wall 171 becomes an obtuse angle. In these cases, each side walls 171 acts as a leaf spring, which biases the fixed core 14 to the fixed plate 13 side, whereby it is possible to fix the fixed core 14 more strongly.

Reverting to FIG. 7, the cap 17 of this embodiment has a movement restriction part 17*d* for restricting a movement of the contact pressure spring 25 in a direction perpendicular to the axis direction of the contact pressure spring 25. The movement restriction part 17*d* is an annular protrusion formed around the through hole 17*a* of the cap 17, and has an outside diameter which is slightly smaller than the inside diameter of the contact pressure spring 25. If the position of the contact pressure spring 25 moves to the side on the cap 17, the contact pressure between the movable contacts and the fixed contacts 21 may decrease, and the performance of the electromagnetic switching device may be lowered. So, by providing the movement restriction part 17*d*, the displacement of the contact pressure spring 25 is prevented, whereby it is possible to prevent the reduction of the contact pressure between the movable contacts and the fixed contacts resulted from the displacement of the contact pressure spring 25.

Figure 21:
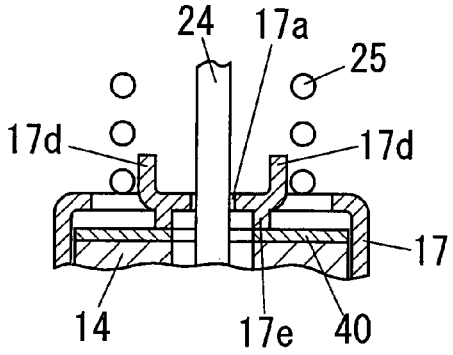
FIG. 21 is an enlarged sectional view showing a substantial part of another configuration of the cap used in the electromagnetic switching device of FIG. 1A.

As shown in FIG. 21, the movement restriction part 17*d* may be formed by cutting and bending a part of the cap 17. In FIG. 21, a plurality of movement restriction parts 17*d* are formed by cutting and bending parts of the cap 17 so that a part of each movement restriction part 17*d* on a side near the through hole 17*a* of the cap 17 becomes a root and a part of each movement restriction part 17*d* on a side which is away from the through hole 17*a* becomes an end. In this case, as compared with a case where the movement restriction part 17*d* is formed by, for example, embossing process, it is possible to easily increase the projecting size of the movement restriction part 17*d*, whereby it is possible to suppress the displacement of the contact pressure spring 25 more.

When the movement restriction part 17*d* is formed by cutting and bending the cap as shown in FIG. 21, contact powder generated by the contact between the movable contacts and the fixed contacts may enter the through hole 14*a* of the fixed core 14 through a hole formed by cutting and bending the cap, and it may interfere with the motion of the movable core 15. Therefore, when the movement restriction part 17*d* is formed by cutting and bending the cap, it is preferable that the cap 17 has, on a surface on the fixed core side, an annular isolation wall 17*e* for isolating the through hole 14*a* of the fixed core 14 from the hole formed by forming the movement restriction part 17*d*. In FIG. 21, the end of the isolation wall 17*e* is in contact with the rubber sheet 40. In this case, it is possible to prevent that the contact powder enters the through hole 14*a* of the fixed core 14 through the hole of the cap.

Figure 22:
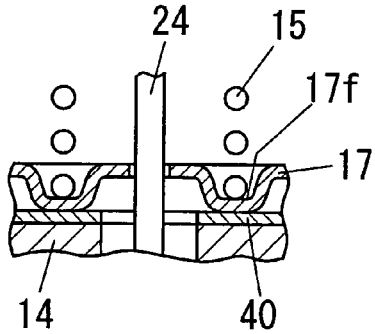
FIG. 22 is an enlarged sectional view showing a substantial part of another configuration of the cap used in the electromagnetic switching device of FIG. 1A.

The constitution of the movement restriction part 17*d* is not limited to the above mentioned constitutions. For example, as shown in FIG. 22, the cap 17 may have an annular gutter 17*f*, which projects to the fixed core 14 side and into which one end of the contact pressure spring 25 is fitted, and the gutter provides (in other words, forms or defines) the movement restriction part 17*d*, and the outer bottom of the gutter 17*f* is in contact with the rubber sheet (the third cushioning member) 40. In this case, it is possible to restrict the movement of the contact pressure spring 25 by the annular gutter 17*f*, and furthermore, because the outer bottom of the gutter 17*f* is in contact with the rubber sheet 40, the contact area between the rubber sheet 40 and the cap 17 is reduced, whereby the transmission of the vibration generated in the electromagnetic device to the case 3 is more suppressed.

Figure 23:
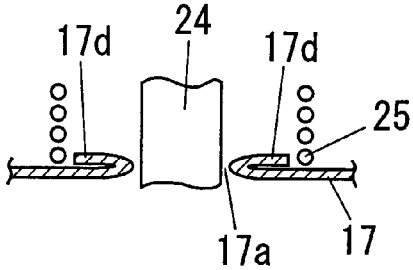
FIG. 23 is an enlarged sectional view showing a substantial part of another configuration of the cap used in the electromagnetic switching device of FIG. 1A.

As shown in FIG. 23, the through hole 17*a* and the movement restriction part 17*d* may be formed at one time by cutting and bending the cap 17.

Figure 24:
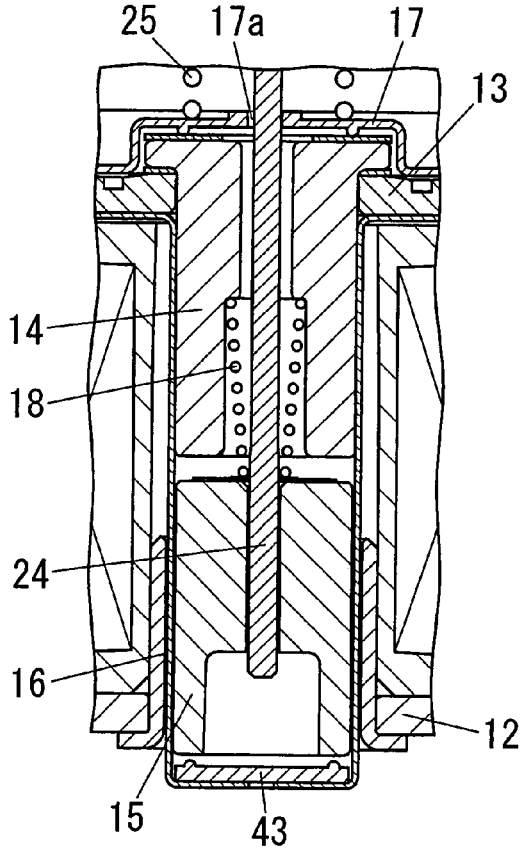
FIG. 24 is an enlarged sectional view showing a substantial part of another configuration of the electromagnetic switching device of FIG. 1A.

By the way, in the cap 17 shown in FIGS. 21 to 23, an inside diameter of the through hole 17*a* is formed to be almost equal to or slightly larger than an outside diameter of the movable shaft 24, and a lean of the movable shaft 24 is prevented by the inner surface of the through hole 17*a* of the cap and the guide cylinder 16. In the electromagnetic device 1 shown in FIG. 2, the lean of the movable shaft 24 is prevented by contact between the movable shaft 15 and the inner surface of the guide cylinder 16. However, in this case, in order to prevent the lean of the movable shaft 24, it is necessary to minimize a clearance between the movable core 15 and the guide cylinder 16, which requires extremely high degree of precision for the manufacturing of the movable core 15 and the guide cylinder 16. So, as shown in FIG. 24, the inside diameter of the through hole 17*a* may be formed to be almost equal to the outside diameter of the movable shaft 24, and the lean of the movable shaft 24 may be prevented by the contact between the movable shaft 24 and the inner surface of the through hole of the cap as well as the contact between the movable core 15 and the inner surface of the guide cylinder 16. In this case, it is possible to prevent the lean of the movable shaft even when these parts are not manufactured with dimensional precision as high as FIG. 2. By preventing the lean of the movable shaft, poor contact of the contact device due to the lean of the movable shaft, and so on can be prevented, whereby it is possible to increase the reliability of the electromagnetic switching device.

Figure 25A:
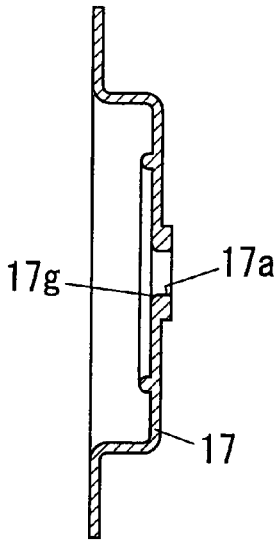
FIG. 25A is a cross-sectional view showing another configuration of the cap used in the electromagnetic switching device of FIG. 1A.
Figure 25B:
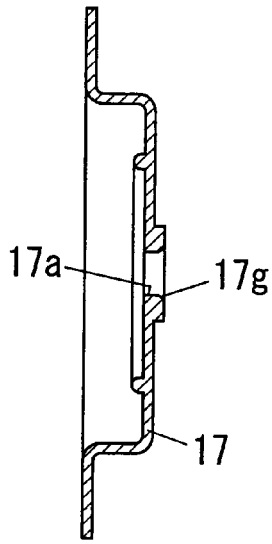
FIG. 25B is a cross-sectional view showing another configuration of the cap used in the electromagnetic switching device of FIG. 1A.
Figure 25C:
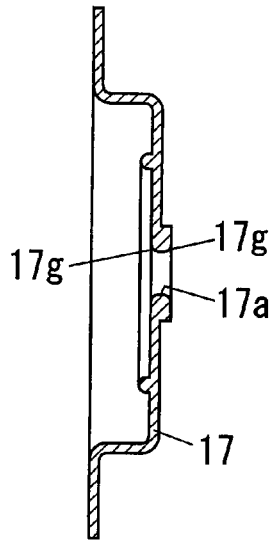
FIG. 25C is a cross-sectional view showing another configuration of the cap used in the electromagnetic switching device of FIG. 1A.

As shown in FIG. 25A, in order to reduce the friction between the movable shaft 24 and the through hole 17*a* of the cap 17, the periphery 17*g* of the through hole 17*a* of the cap 17 on the fixed core 14 side may be formed into a curved surface. Or, as shown in FIG. 25B, the periphery 17*g* of the through hole 17*a* of the cap 17 on the movable armature side may be formed into a curved surface. Or, as shown in FIG. 25C, the peripheries 17*g* of both ends of the through hole 17*a* may be formed into a curved surface, respectively.

By the way, in this embodiment, as shown in FIG. 1A, both ends of the excitation coil 11 are connected to a pair of coil terminals 19, and the case 3 is provided with a pair of external terminals 36, one end 36*a* of each of which projects from the case 3 to the outside and the other end 36*b* of each of which projects inside the case, and which is to be connected to an external source electrically. The pair of coil terminals 19 and the pair of external terminals 36 (36*b*) are connected to each other by connecting members 50 having flexibility and made of a conductive material.

In the conventional electromagnetic switching device, the coil terminals and the external terminals are, mechanically and electrically, connected and soldered to each other. However, as mentioned above, because, in the electromagnetic switching device 1 of this embodiment, the electromagnetic device 1 is held through the cushioning member 32 in the case 3, when the electromagnetic device 1 vibrates in the case, the coil terminals 19 held by the electromagnetic device 1 also vibrate. So, if the coil terminals 19 are mechanically connected to the external terminals 36, because the coil terminals 19 vibrate while the external terminals 36 are fixed to the case 3, each terminal becomes stressed, and poor contact, such as peeling of solder, may occur.

So, as shown in FIG. 1, it is preferable that the pair of coil terminals 19 and the pair of external terminals 36 are connected to each other by the connecting members 50 having flexibility and made from a conductive material. In this case, even when the electromagnetic device 1 vibrates, it is possible to reduce the stress to be applied to the coil terminals 19 and the external terminals 36 by the connecting members 50 having the flexibility, and it is possible to increase the resistance to vibration of the electromagnetic switching device. Furthermore, because the vibration of the coil terminals 19 is not directly transmitted to the external terminals 36, it is possible to reduce the vibration to be transmitted from the electromagnetic device 1 to the case 3.

Figure 26A:
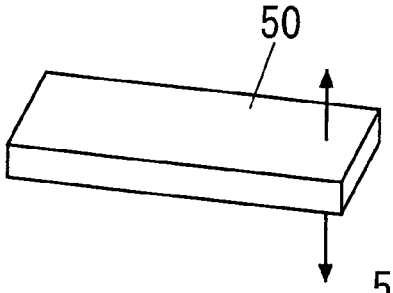
FIG. 26A is a perspective view for explaining a shape of a connecting member for connecting between a coil terminal and an external terminal, used in the electromagnetic switching device of FIG. 1A.
Figure 26B:
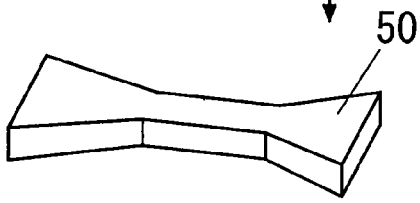
FIG. 26B is a perspective view for explaining another shape of the connecting member for connecting between the coil terminal and the external terminal, used in the electromagnetic switching device of FIG. 1A.
Figure 26C:
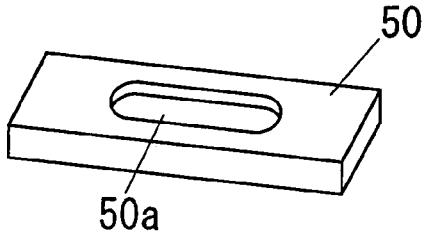
FIG. 26C is a perspective view for explaining another shape of the connecting member for connecting between the coil terminal and the external terminal, used in the electromagnetic switching device of FIG. 1A.

The shape of the connecting member 50 is not particularly limited. For example, as shown in FIG. 26A, the connecting member 50 may be formed into a rectangular plate-like shape. In this case, the connecting member 50 can bend in a direction of an arrow of FIG. 26A, so it is possible to attenuate the vibration to be transmitted from the electromagnetic device 1. Furthermore, the connecting member can be formed from widely diffused parts, so it is possible to lower the manufacturing cost. As shown in FIG. 26B, in order to assist the connecting member 50 to be bent easily, the width of the middle part of the plate-like connecting member 50 may be thinned, or as shown in FIG. 26C, a through hole 50*a* may be formed in the middle part thereof.

Figure 27A:
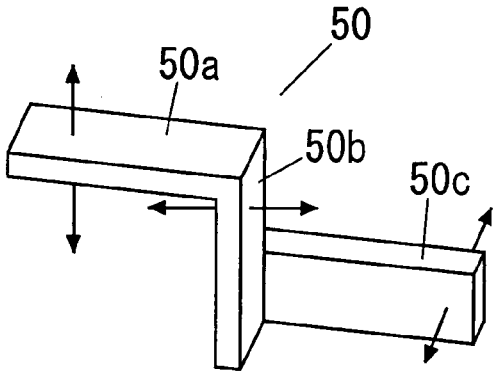
FIG. 27A is a perspective view for explaining another shape of the connecting member for connecting between the coil terminal and the external terminal, used in the electromagnetic switching device of FIG. 1A.
Figure 27B:
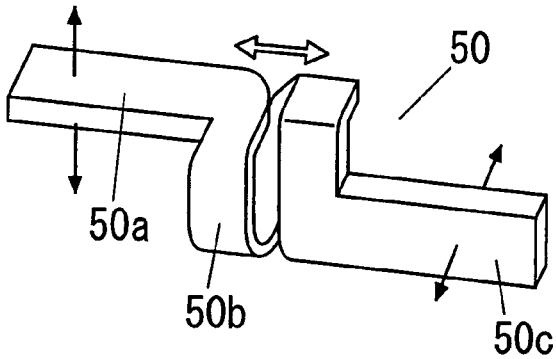
FIG. 27B is a perspective view for explaining another shape of the connecting member for connecting between the coil terminal and the external terminal, used in the electromagnetic switching device of FIG. 1A.

As shown in FIG. 27A, the connecting member 50 may be comprises a plate-like first member 50*a* having a surface orthogonal to a first direction (for example, a vertical direction of FIG. 27A), a plate-like second member 50*b* having a surface orthogonal to a second direction (for example, a horizontal direction of FIG. 27A) perpendicular to the first direction, and a plate-like third member 50*c* having a surface orthogonal to a third direction (for example, a back-and-forth direction of FIG. 27A) perpendicular to the first and second directions. In this case, a vibration to each direction, that is, to the vertical direction, the horizontal direction, and the back-and-forth direction, can be absorbed by the bending of each member 50*a* to 50*c* which corresponds to each direction, whereby it is possible to increase the resistance to vibration. Or, as shown in FIG. 27B, in order to distort the second member 50*b* in the horizontal direction of FIG. 27B, the second member 50*b* may be formed into a spiral shape.

Figure 28:
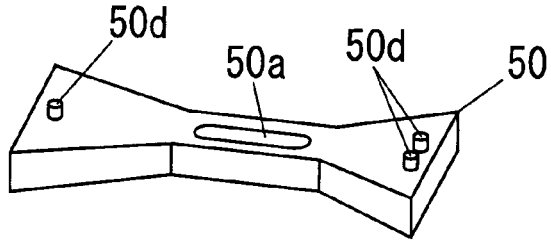
FIG. 28 is a perspective view for explaining another shape of the connecting member for connecting between the coil terminal and the external terminal, used in the electromagnetic switching device of FIG. 1A.
Figure 29:
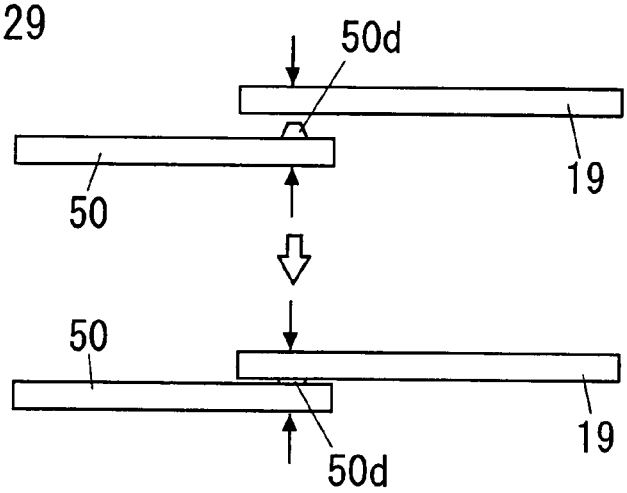
FIG. 29 is a view for explaining a method for connecting the connecting member of FIG. 28 to another member.

As shown in FIG. 28, when the connecting member 50 has a plate-like shape, it is preferable that the connecting member 50 has a junction part 50*d* for welding at, at least, one of a position to be connected to the coil terminal 19 and a position to be connected to the external terminal 36. In FIG. 29, the junction parts 50*d* are formed at both the position to be connected to the coil terminals 19 and the position to be connected to the external terminals 36. The junction part 50*d* has a generally column-like shape, and is formed integrally with the connecting member 50, and as shown in FIG. 29, the connecting member 50 and the coil terminal 19, or the external terminal 36, are mechanically and electrically connected to each other by bringing the connecting member 50 into contact with one end of the coil terminal 19, or one end of the external terminal 36 (in FIG. 29, one end of the coil terminal 19 is shown.), and by performing resistance welding. As mentioned above, by forming the junction part 50*d* on the connecting member 50 and performing resistance welding between the connecting member 50 and the coil terminal 19 and/or the external terminal 36, it is possible to increase a connection quality between the connecting member 50 and the coil terminals 19 and/or the external terminals 36, and to increase the resistance to vibration.

Figure 30:
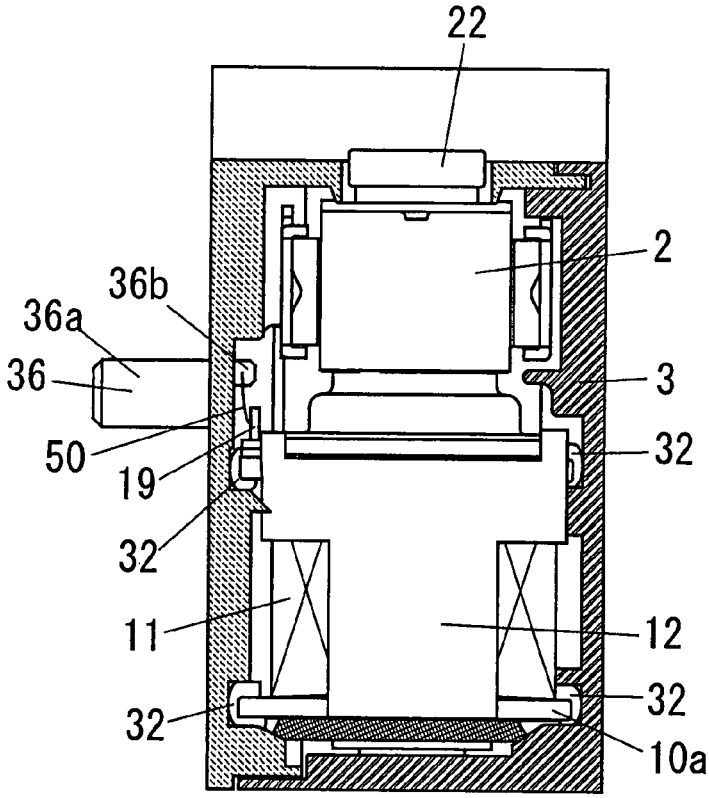
FIG. 30 is a cross-sectional view showing another configuration of the electromagnetic switching device of FIG. 1A.

Or, as shown in FIG. 30, the connecting member 50 may be formed into a line-like shape. For example, the line-like connecting member 50 may be (in other words, can be formed by) a strand of a plurality of elemental wires. In this case, it is possible to lower the manufacturing cost and to increase the flexibility of the connecting member. When the connecting member 50 is a strand, it is preferable that the strand is coated by an insulating material. In this case, it is possible to route the strand freely in the case 3.

Figure 31A:
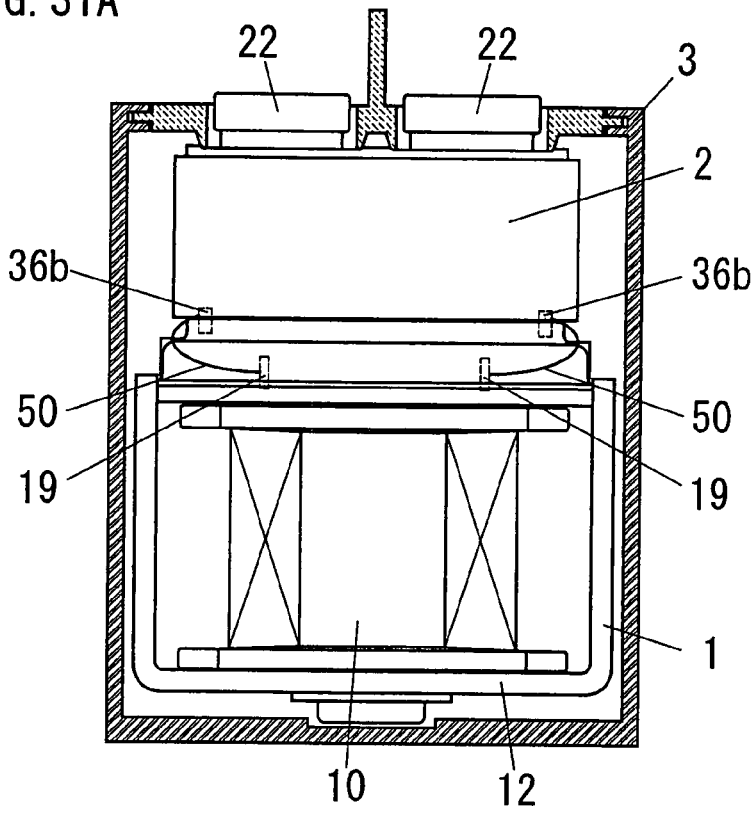
FIG. 31A is a cross-sectional view for explaining a method for connecting between the coil terminal and the external terminal in the electromagnetic switching device of FIG. 30.
Figure 31B:
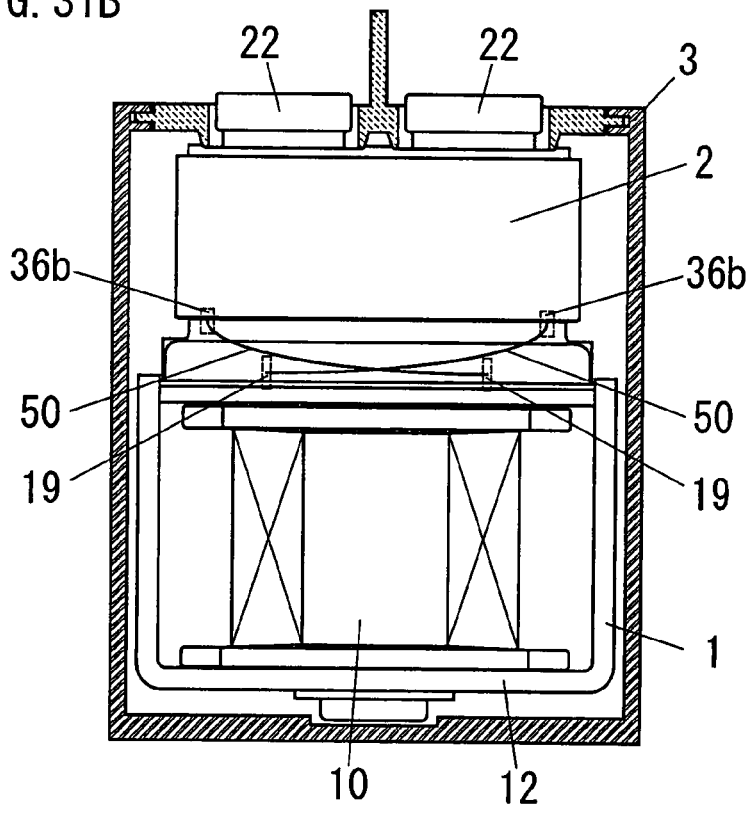
FIG. 31B is a cross-sectional view for explaining another method for connecting between the coil terminal and the external terminal in the electromagnetic switching device of FIG. 30.

As shown in FIG. 31A, when connecting member 50 has a line-like (or, wire-like) shape, it is preferable to connect between the coil terminal 19 and the external terminal 36 by the connecting member 50 in a condition where the connecting member 50 is sagged. And, as shown in FIG. 31B, it is also preferable that the coil terminal 19 on the right side of FIG. 31B and the external terminal 36 on the left side thereof are connected to each other by the connecting member 50 and the coil terminal 19 on the left side of FIG. 31B and the external terminal 36 on the right side thereof are connected to each other by the connecting member 50. That is, it is preferable that two connecting members 50 cross each other. In these cases, the length of the connecting member 50 can be increased, whereby it is possible to absorb the vibration of the coil terminals 19 sufficiently.

Figure 32:
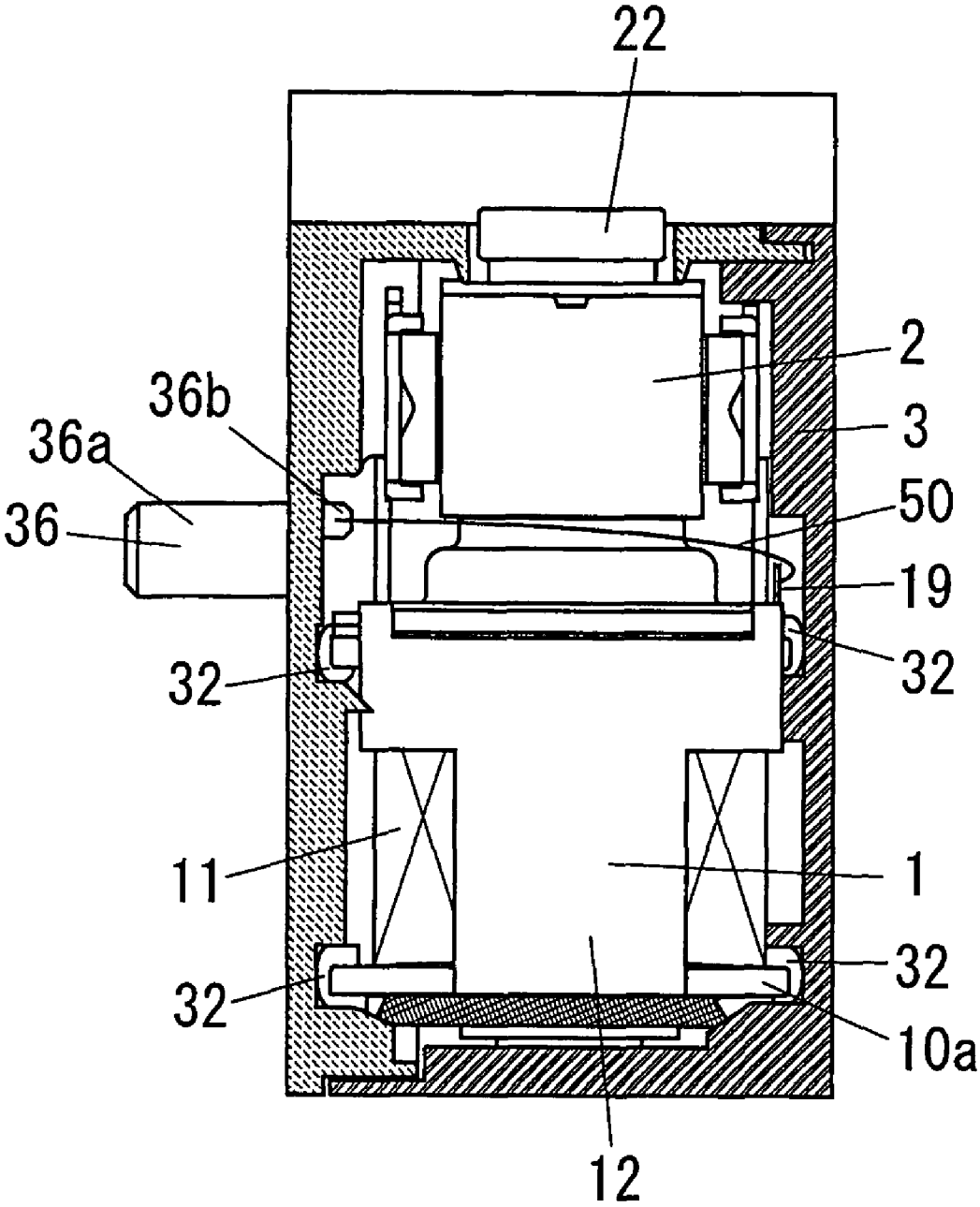
FIG. 32 is a cross-sectional view for explaining another method for connecting between the coil terminal and the external terminal in the electromagnetic switching device of FIG. 30.

Furthermore, as shown in FIG. 32, it is also preferable that the coil terminal 19 and the external terminal 36 are disposed at positions opposite to each other in the case 3. In this case, too, the length of the connecting member 50 can be increased, whereby it is possible to absorb the vibration of the coil terminals 19 sufficiently. Furthermore, it is also possible to suppress the vibration of the case. Furthermore, by disposing the coil terminal 19 and the external terminal 36 apart from each other, it becomes easy to assemble the device.

Or, the connecting member 50 may be formed integrally with the coil terminal 19 (not shown). In this case, it is possible to reduce the number of parts.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. An electromagnetic switching device comprising:

an electromagnetic device comprising a coil bobbin, an excitation coil, a movable core and a fixed core, in which said movable core comes into contact with or separates from said fixed core in response to energization of said excitation coil wound around said coil bobbin, a contact device with a fixed contact and a movable contact which comes into contact with or separates from the fixed contact in conjunction with a movement of said movable core of said electromagnetic device, and a boxy case for housing said electromagnetic device and said contact device, wherein said coil bobbin has a flange at its end in an axis direction of the coil bobbin, said case having, on its inner surface, a recess in which a periphery of the flange of said coil bobbin is fitted, a cushioning member for absorbing an impact to be transmitted from said electromagnetic device to said case being disposed in said recess, and wherein only a part of the electromagnetic device is supported by said case, said part of the electromagnetic device being the periphery of the flange of said coil bobbin, said periphery being supported by said recess of said case through said cushioning member wherein said recess is formed at a lateral side of inner surface of said case, and said cushioning member is interleaved between said recess and the periphery of the flange of said coil bobbin.

2. The electromagnetic switching device as set forth in claim 1, wherein said cushioning member is made of a raw material having many air spaces in it.

3. The electromagnetic switching device as set forth in claim 2, wherein said cushioning member is formed by stacking a plurality of fine materials formed into a cloth shape or a non-woven fabric shape.

4. The electromagnetic switching device as set forth in claim 1, wherein said contact device has a fixed terminal connected to said fixed contact, said case having a terminal window for exposing said fixed terminal to the outside, a second cushioning member being disposed so that it tills a gap between a periphery of said terminal window and said contact device.

5. The electromagnetic switching device as set forth in claim 1, wherein said electromagnetic device has a fixed plate for holding said fixed core, said fixed plate having a through hole through which one end of said fixed core passes, said fixed core having a cylindrical shape with a flange at its end, said flange being locked to a periphery of the through hole of said fixed plate, said fixed plate having a cap which covers the flange of said fixed core and restricts a movement of said fixed core, a third cushioning member made of a material having elasticity being disposed between said cap and said flange.

6. The electromagnetic switching device as set forth in claim 5, wherein said cap has a support protrusion on a surface facing said third cushioning member, an end of the support protrusion being in contact with said third cushioning member.

7. The electromagnetic switching device as set forth in claim 6, wherein said support protrusion is formed into an annular shape around a center axis of said fixed core.

8. The electromagnetic switching device as set forth in claim 6, wherein said support protrusion is formed on a part of an annular shape around a center axis of said fixed core.

9. The electromagnetic switching device as set forth in claim 6, wherein an end of said support protrusion which is in contact with said third cushioning member is formed into a curved surface which projects to the third cushioning member side.

10. The electromagnetic switching device as set forth in claim 6, wherein an end of said support protrusion which is in contact with said third cushioning member is tapered toward said third cushioning member side.

11. The electromagnetic switching device as set forth in claim 6, wherein said cap is made of a metal plate, said support protrusion being formed by cutting and bending the metal plate and having flexibility in an axis direction of said fixed core.

12. The electromagnetic switching device as set forth in claim 11, wherein an end of said support protrusion which is in contact with said third cushioning member is bent toward said third cushioning member side.

13. The electromagnetic switching device as set forth in claim 5, wherein said cap comprises a rectangular main wall which covers an end face of the flange of said fixed core, side walls which are formed by bending ends of said main wall toward the flange side and cover a side surface of the flange, and fixed parts which are formed by bending an end of each side wall and are fixed to said fixed plate.

14. The electromagnetic switching device as set forth in claim 13, wherein said side walls are formed by bending a pair of ends of the main wall toward the flange side, said cap further comprises reinforcing walls which are formed by bending the other pair of ends of the main wall toward the flange side and whose ends are in contact with said fixed plate.

15. The electromagnetic switching device as set forth in claim 14, wherein said cap further comprises welding parts which are formed by bending ends of said reinforcing walls and are welded to said fixed plate.

16. The electromagnetic switching device as set forth in claim 13, wherein said cap further comprises a connection part for connecting between each of said side walls and each of said fixed parts.

17. The electromagnetic switching device as set forth in claim 5, wherein said contact device has a movable armature having said movable contact, a movable shaft whose one end is connected to said movable armature and the other end is connected to said movable core, and a contact pressure spring which is disposed between said cap and said movable armature and biases said movable contact to the fixed contact side, said cap having a movement restriction part for restricting a movement of said contact pressure spring in a direction perpendicular to an axis direction of said contact pressure spring.

18. The electromagnetic switching device as set forth in claim 17, wherein said movement restriction part is formed by cutting and bending a part of said cap.

19. The electromagnetic switching device as set forth in claim 18, wherein said fixed core has a through hole through which said movable shaft passes, said cap having, on a surface on the fixed core side, an annular isolation wall for isolating said through hole of said fixed core from a hole formed by forming said movement restriction part.

20. The electromagnetic switching device as set forth in claim 17, wherein said cap has an annular gutter which projects to the fixed core side and into which one end of said contact pressure spring is fitted, said gutter providing said movement restriction part, and an outer bottom of said gutter being in contact with said third cushioning member.

21. The electromagnetic switching device as set forth in claim 5, wherein said contact device has a movable armature having said movable contact, a movable shaft whose one end is connected to said movable armature and the other end is connected to said movable core, said electromagnetic device having a guide cylinder which is fixed to said fixed plate and houses said movable core movably, said cap having a through hole through which said movable shaft passes, said movable shaft being prevented from leaning by contact between said movable core and an inner surface of said guide cylinder and contact between said movable shaft and an inner surface of said through hole of said cap.

22. The electromagnetic switching device as set forth in claim 1, wherein said electromagnetic device has a coil terminal to which an end of said excitation coil is connected, said case having an external terminal whose one end projects from said case to the outside and the other end projects inside the case, said coil terminal' and said external terminal being connected to each other by a connecting member having flexibility and made of a conductive material.

23. The electromagnetic switching device as set forth in claim 22, wherein said connecting member is formed into a plate-like shape.

24. The electromagnetic switching device as set forth in claim 23, wherein said connecting member comprises a plate-like first member having a surface orthogonal to a first direction, a plate-like second member having a surface orthogonal to a second direction perpendicular to the first direction, and a plate-like third member having a surface orthogonal to a third direction perpendicular to the first and second directions.

25. The electromagnetic switching device as set forth in claim 23, wherein said connecting member has a junction part for welding at at least one of a position to be connected to said coil terminal and a position to be connected to said external terminal.

26. The electromagnetic switching device as set forth in claim 22, wherein said connecting member is formed into a line-like shape.

27. The electromagnetic switching device as set forth in claim 26, wherein said connecting member is a strand of a plurality of elemental wires.

28. The electromagnetic switching device as set forth in claim 27, wherein said strand is coated by an insulating material.

29. The electromagnetic switching device as set forth in claim 22, wherein said coil terminal and said external terminal are disposed at positions opposite to each other in said case.

30. The electromagnetic switching device as set forth in claim 22, wherein said connecting member is formed integrally with said coil terminal.

31. The electromagnetic switching device as set forth in claim 1, wherein said electromagnetic device further comprises a guide cylinder disposed in said coil bobbin, said fixed core is housed in the inside of said guide cylinder, and said movable core is movably housed in said guide cylinder in a condition where it faces said fixed core.

* * * * *